US009627769B2

(12) United States Patent
Koo et al.

(10) Patent No.: US 9,627,769 B2
(45) Date of Patent: Apr. 18, 2017

(54) SLOT ANTENNA AND INFORMATION TERMINAL APPARATUS USING THE SAME

(71) Applicants: LG Display Co., Ltd., Seoul (KR); Korea Advanced Institute of Science and Technology, Daejeon (KR)

(72) Inventors: Hyungjoon Koo, Seoul (KR); Heejung Hong, Seoul (KR); Sooji Lee, Daegu (KR); Kyoungsub Oh, Gyeonggi-do, OH (US); Jongwon Yu, Daejeon (KR)

(73) Assignees: LG Display Co., Ltd., Seoul (KR); Korea Advanced Institute of Science and Technology, Daejeon (KR)

( * ) Notice: Subject to any disclaimer, the term of this patent is extended or adjusted under 35 U.S.C. 154(b) by 406 days.

(21) Appl. No.: 14/136,571

(22) Filed: Dec. 20, 2013

(65) Prior Publication Data

US 2014/0184450 A1 Jul. 3, 2014

(30) Foreign Application Priority Data

Dec. 28, 2012 (KR) ..... 10-2012-0157534

(51) Int. Cl.

| | |
|---|---|
| ***H01Q 13/10*** | (2006.01) |
| ***H01Q 1/22*** | (2006.01) |
| ***H01Q 1/24*** | (2006.01) |
| ***H01Q 5/335*** | (2015.01) |
| ***H01Q 5/385*** | (2015.01) |

(52) U.S. Cl.

CPC ..... *H01Q 13/10* (2013.01); *H01Q 1/2266* (2013.01); *H01Q 1/243* (2013.01); *H01Q 5/335* (2015.01); *H01Q 5/385* (2015.01); *H01Q 13/103* (2013.01); *H01Q 13/106* (2013.01)

(58) Field of Classification Search

CPC .... H01C 13/103; H01C 13/106; H01C 13/10; H01C 1/2266

See application file for complete search history.

(56) References Cited

U.S. PATENT DOCUMENTS

| | | | |
|---|---|---|---|
| 6,339,400 | B1 | 1/2002 | Flint et al. |
| 6,686,886 | B2 | 2/2004 | Flint et al. |
| 2004/0257283 | A1 | 12/2004 | Asano et al. |
| 2005/0146475 | A1 | 7/2005 | Bettner et al. |
| 2005/0206573 | A1 | 9/2005 | Iigusa et al. |
| 2006/0290569 | A1 | 12/2006 | Boyle |
| 2009/0231215 | A1 | 9/2009 | Taura |
| 2010/0225553 | A1 | 9/2010 | Minard et al. |

(Continued)

FOREIGN PATENT DOCUMENTS

| | | | |
|---|---|---|---|
| CN | 1482704 | A | 3/2004 |
| CN | 1836350 | A | 9/2006 |

(Continued)

OTHER PUBLICATIONS

Office Action issued in corresponding Chinese Patent Application No. 201310706048.X dated Aug. 5, 2015.

(Continued)

*Primary Examiner* — Hoang V Nguyen
*Assistant Examiner* — Michael Bouizza
(74) *Attorney, Agent, or Firm* — Morgan, Lewis & Bockius LLP

(57) ABSTRACT

A slot antenna and an information terminal apparatus using the same are provided. The slot antenna comprises: a conductive housing; and at least one slot formed on the corner and edge of the conductive housing.

10 Claims, 36 Drawing Sheets

(56) References Cited

U.S. PATENT DOCUMENTS

| | | | |
|---|---|---|---|
| 2010/0321255 | A1 | 12/2010 | Kough et al. |
| 2012/0068893 | A1 | 3/2012 | Guterman et al. |
| 2012/0280876 | A1 | 11/2012 | Qu |
| 2012/0313834 | A1 | 12/2012 | Eom et al. |
| 2013/0135155 | A1 | 5/2013 | Zhang |

FOREIGN PATENT DOCUMENTS

| | | | |
|---|---|---|---|
| CN | 101800361 | A | 8/2010 |
| CN | 101826656 | A | 9/2010 |
| CN | 102013555 | A | 4/2011 |
| CN | 102013568 | A | 4/2011 |
| CN | 201910483 | U | 7/2011 |
| CN | 102394354 | A | 3/2012 |
| EP | 2 518 830 | A1 | 10/2012 |
| EP | 2 621 017 | A1 | 7/2013 |
| EP | 2 667 448 | A | 11/2013 |
| JP | 2003-234615 | A | 8/2003 |
| JP | 2004-242034 | A | 8/2004 |
| JP | 2005-079832 | A | 3/2005 |
| JP | 2010-187107 | A | 8/2010 |
| JP | 2010-187152 | A | 8/2010 |
| KR | 10-2012-0044229 | A | 5/2012 |

OTHER PUBLICATIONS

Communication dated May 26, 2015 from the German Patent and Trademark Office in counterpart German Application No. 102013 114 205.2.

British Office Action dated May 27, 2014 for corresponding British Patent Application No. 1322105.6.

2nd Notification of Office Action dated Mar. 25, 2016 from the State Intellectual Property Office of China in counterpart Chinese Application No. 201310706048.X.

FIG. 6

| WWAN Bands | | | Operating Bands | | | |
|---|---|---|---|---|---|---|
| | | | | BW[MHz] | | BW[%] |
| GSM 850 | Tx | 836MHz | Lower Band | More than 104 MHz | | More than 11.712% |
| | Rx | 880MHz | | | | |
| GSM 900 | Tx | 900MHz | | | | |
| | Rx | 940MHz | | | | |
| GSM 1800 | Tx | 1750MHz | Upper Band | Case 1 | More than 390MHz | More than 20.051% |
| | Rx | 1840MHz | | | | |
| GSM 1900 | Tx | 1880MHz | | | | |
| | Rx | 1960MHz | | Case 2 | More than 210MHz +(fc=2040MHz) | More than 11.321% +BWfc=2040MHz |
| UMTS | Tx | 1950MHz | | | | |
| | Rx | 2140MHz | | | | |

SLOT ANTENNA AND INFORMATION TERMINAL APPARATUS USING THE SAME

This application claims the benefit of Korean Patent Application No. 10-2012-0157534 filed on Dec. 28, 2012, which is incorporated herein by reference for all purposes as if fully set forth herein.

BACKGROUND

Field

This document relates to a slot antenna which is applicable to a variety of information terminal apparatuses and formed directly on a conductive housing of the information terminal apparatus, and an information terminal apparatus using the same.

Related Art

A slot antenna is a type of antenna that has a long, slim slot formed on a wide conductor plate and causes the slot to emit radio waves. The slot antenna has a number of limitations when used in a small-sized, portable information terminal such as a laptop computer. The slot antenna is known in U.S. Laid-Open Patent NOs. 2004-0257283 and 2005-0146475, U.S. Pat. Nos. 6,339,400 and 6,686,886, and Korean Laid-Open Patent No. 10-2012-0044229. The slot antenna structure disclosed in U.S. Laid-Open Patent NOs. 2004-0257283 and 2005-0146475 cannot be implemented because lowering the display housing leads to a shortage of slot antenna design space and a narrower bandwidth.

The laptop computer comprises a main body equipped with a keyboard, a touchpad, etc and a display unit rotatably mounted to the main body via a hinge and incorporating a liquid crystal display panel. The publicly known slot antenna is formed on a PCB (printed circuit board) and embedded in the main body or display unit.

If the housing (hereinafter, referred to as "display housing") of the display unit in the laptop computer is non-conductive, the slot antenna cannot be formed directly in the display housing. When manufacturing a slot antenna on the PCB and embedding the PCB in the display unit above the hinge of the laptop computer, the PCB should be spaced enough away from the liquid crystal display panel to achieve a high radiation efficiency. As such, it is necessary to secure enough space between the PCB where the slot antenna is formed and the liquid crystal display panel. The display unit of the laptop computer tends to be slimmer in design. Due to this, it is difficult for the display unit of the laptop computer to have space for the PCB with the slot antenna.

Embedding the PCB with the slot antenna in the display unit of the laptop computer may lower the radiation efficiency of the slot antenna due to the liquid crystal display panel. Common electrodes, pixel electrodes, etc formed on the entire surface of the liquid crystal display panel are formed of a transparent electrode material such as ITO (Indium Tin Oxide). An ITO film partially absorbs the energy radiated from the slot antenna and causes a reduction in radiation efficiency. The farther the slot antenna is from the ITO film, the better the radiation efficiency. For this reason, locating the PCB with the slot antenna on the back side of the liquid crystal display panel lowers the radiation efficiency because of the ITO film. Accordingly, when embedding the PCB with the slot antenna in the display unit of the laptop computer, the ITO film should be removed partially from the liquid crystal display panel in order to provide distance between the slot antenna and the ITO film. This approach incurs additional processes and costs in partially removing the ITO film.

If the display housing of the laptop computer is manufactured as a metal housing, and the PCB with the slot antenna is installed within the display housing, the metal housing interrupts the radiation energy from the slot antenna. In this case, the metal housing cannot even act as a reflector since its distance from the slot antenna is very short.

If the PCB with the slot antenna is installed in the main body housing of the laptop computer, the user's hands touching the keyboard and the touch pad may decrease the slot antenna performance. That is, when the user's hands move closer to the slot antenna, the resonance frequency of the slot antenna changes and therefore the slot antenna does not operate at a desired frequency and interrupts communication between electronic devices. When a great deal of energy radiated from the slot antenna is absorbed into the user's hands, the radiation energy becomes significantly weaker, making communication between electronic devices difficult. For example, call quality may be good or poor depending on which part of the phone the user grips, like the death grip problem with Apple's Iphones.

SUMMARY

The present invention has been made in an effort to provide a slot antenna which has enough bandwidth without space limitation and can improve radiation efficiency, and an information terminal apparatus using the same.

A slot antenna according to the present invention comprises: a conductive housing; and at least one slot formed on the corner and edge of the conductive housing.

The slot comprises: a main slot; and at least one parasitic slot separated from the main slot.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 6 is a table showing the frequency ranges of upper and lower bands of the slot antenna of FIGS. 4*a* and 4*b;*

DETAILED DESCRIPTION

Figure 1:
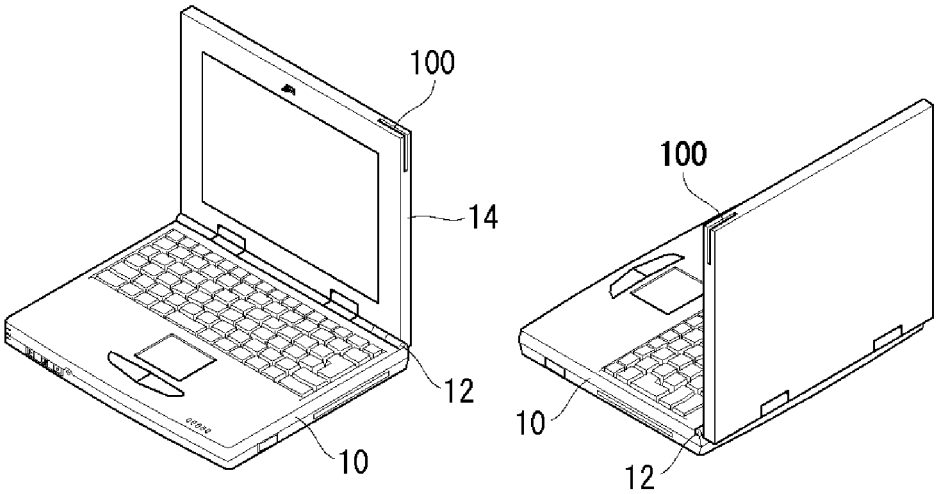
FIGS. 1 and 2 are views showing small-sized information terminals each comprising a slot antenna according to an exemplary embodiment of the present invention.

An information terminal apparatus to which a slot antenna of this invention is applicable comprises a display element and a conductive housing covering the back and sides of the display element. The information terminal apparatus may be a stationary device or a small-sized, portable information terminal. The display element may be implemented as a flat panel display such as a liquid crystal display (LCD), a field emission display (FED), a plasma display panel (PDP), or an electroluminescence device (EL). The electroluminescence device comprises an organic light emitting display with organic light emitting diodes (OLED) formed in pixels.

The slot antenna of this invention is formed directly on the corner and edge of the conductive housing that does not overlap an ITO film of a display panel. Also, the slot antenna of this invention is formed not on the hinge of the information terminal apparatus but on two or more sides on the corner and edge of the conductive housing.

Exemplary embodiments of the present invention will now be described in detail with reference to the accompanying drawings. Throughout the specification, the same reference numerals indicate substantially the same components. Further, in the following description, well-known functions or constructions related to the present invention will not be described in detail if it appears that they could obscure the invention in unnecessary detail.

Figure 2:
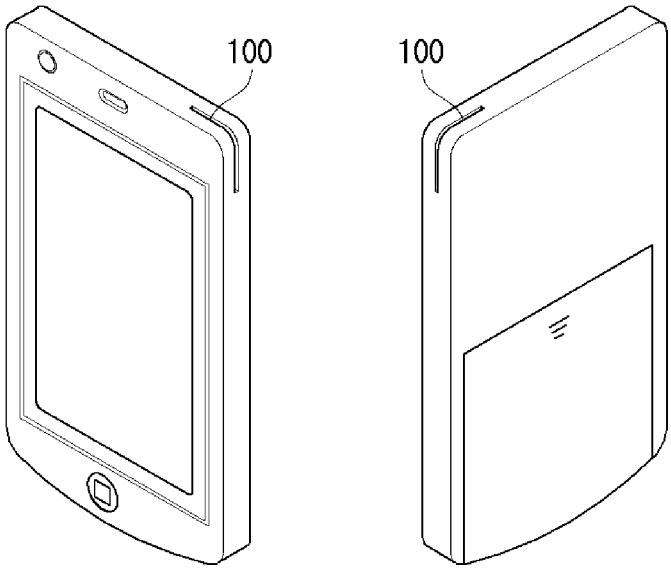
Figure 3:
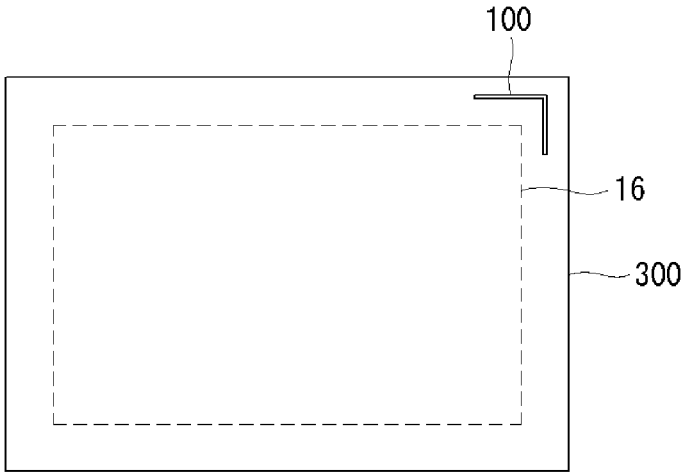
FIG. 3 is a top plan view showing a display panel and a slot antenna shown in FIGS. 1 and 2.

FIGS. 1 and 2 are views showing small-sized information terminals each comprising a slot antenna according to an exemplary embodiment of the present invention. FIG. 3 is a top plan view showing a display panel 16 and a slot antenna.

As shown in FIG. 1, the laptop computer comprises a main body 10 and a display unit 14. A keyboard and a touchpad are installed on the surface of the housing of the main body 10, and a main board comprising various kinds of circuits is installed within the housing. The display unit 14 is mounted to the main body 10 via a hinge 12. As shown in FIG. 3, the display unit 14 is equipped with a display panel 16. A display housing is manufactured as a conductive housing where a slot antenna is formed directly. The conductive housing is configured to surround the sides and back of the display panel. The conductive housing may be either a conductive housing made of conductive resin, or a conductive housing with a metal deposited on the surface of a dielectric material such as plastic resin, or a conductive housing made of metal only.

Smartphones are manufactured in the shape of a hingeless bar, as shown in FIG. 2. The housing of a smartphone is configured to surround the sides and back of the display panel 16. The housing is manufactured as a conductive housing where a slot antenna is formed directly. For a folder-type phone, the display housing above the hinge is manufactured as a conductive housing, like the laptop computer.

In the present invention, a slot antenna is formed directly on the conductive housing, taking into consideration the fact that it is hard to secure space for the slot antenna due to the tendency towards slim information terminal apparatuses and the slot antenna should be located avoiding the ITO film of the display panel. As the slot of the slot antenna is formed directly on the conductive housing of the information terminal apparatus, as shown in FIGS. 1 and 2, the issue of design space within the display housing does not need to be considered. Moreover, the problem of radiation efficiency degradation caused by the ITO film of the display panel 16 can be solved by forming the slot antenna on the corner or edge, which is far from the display panel 16.

Because the ITO film of the display panel 16 is thin, it reflects or absorbs the normal E-field and the tangential H-field and passes the tangential E-field and the normal H-field therethrough. If the slot of the slot antenna is fed at the center, the H-field is strong at both ends and the center of the slot, and the E-field is strong in the space between both ends and the center of the slot. Taking these features into account, the slot antenna is designed to be located on the corner or edge of the conductive housing. In the present invention, to eliminate the effect of the ITO film of the display panel and implement a slot antenna having a wide bandwidth, a slot is formed on two or more sides meeting near the corner or edge of the information terminal apparatus, and the slot is fed at the center. Slot antenna feeding methods include a direct feeding method in which a coaxial cable is connected directly to the slot and a coupling feeding method for feeding the slot antenna without connecting a coaxial cable or microstrip line directly to the slot. In order to match the slot impedance, lumped elements may be used, or the microstrip line structure may be modified.

The slot antenna is formed on two or more sides on the corner or edge that does not overlap the display panel in the conductive housing of the information terminal apparatus. For example, the slot antenna's slot may be formed on one or more sides and the bottom meeting at the corner or edge of the conductive housing. The number of slots is not less than 1. The slot may be configured to penetrate the conductive housing, or the inside of the slot may be filled with a dielectric material such as plastic resin. Although FIGS. 1 to 3 illustrate an example in which the slot antenna is formed on one top corner portion of the conductive housing, the present invention is not limited thereto. For example, the slot antenna may be located on at least one corner or edge which does not overlap the display panel 16. The length of the slot determines the resonance frequency of the antenna. The width and length of the slot and the size of the conductive material of which the slot is formed in the display housing determine the impedance of the antenna.

Figure 4A:
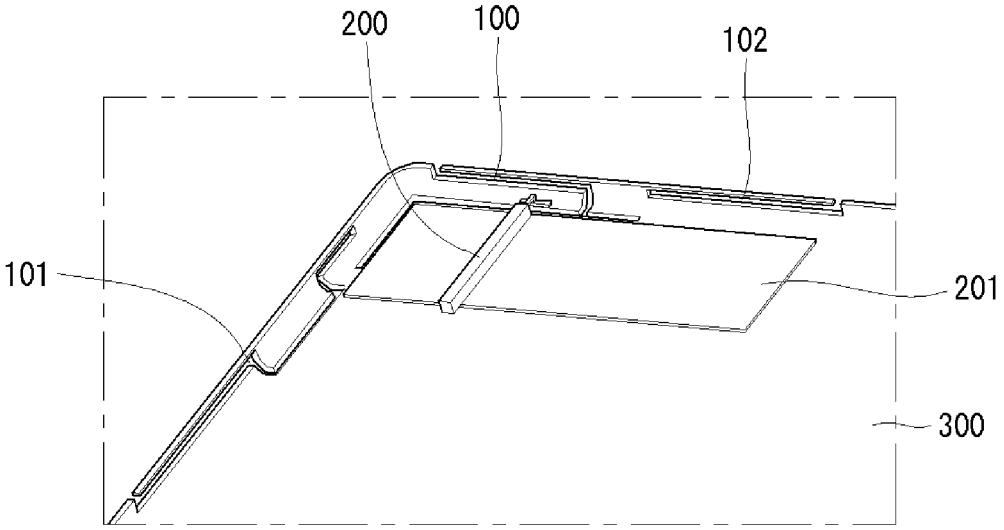
FIGS. 4*a* and 4*b* are views showing a slot antenna according to a first exemplary embodiment of the present invention.
Figure 4B:
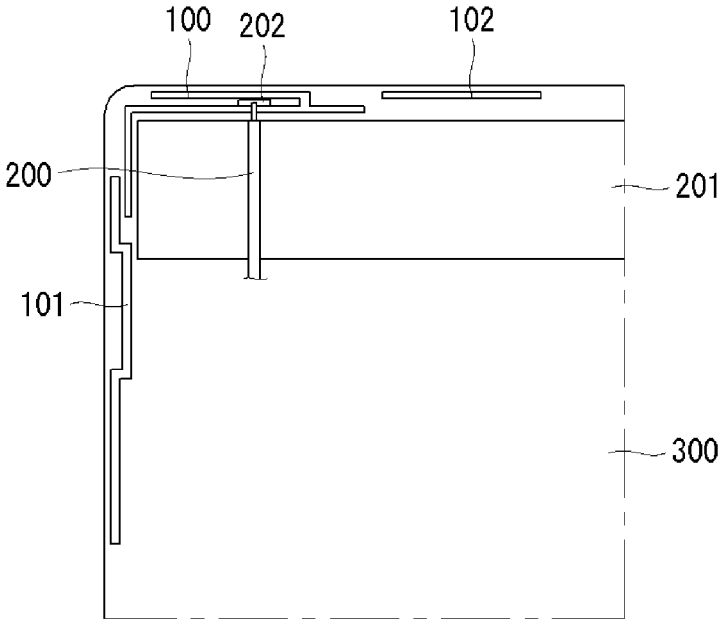
Figure 5:
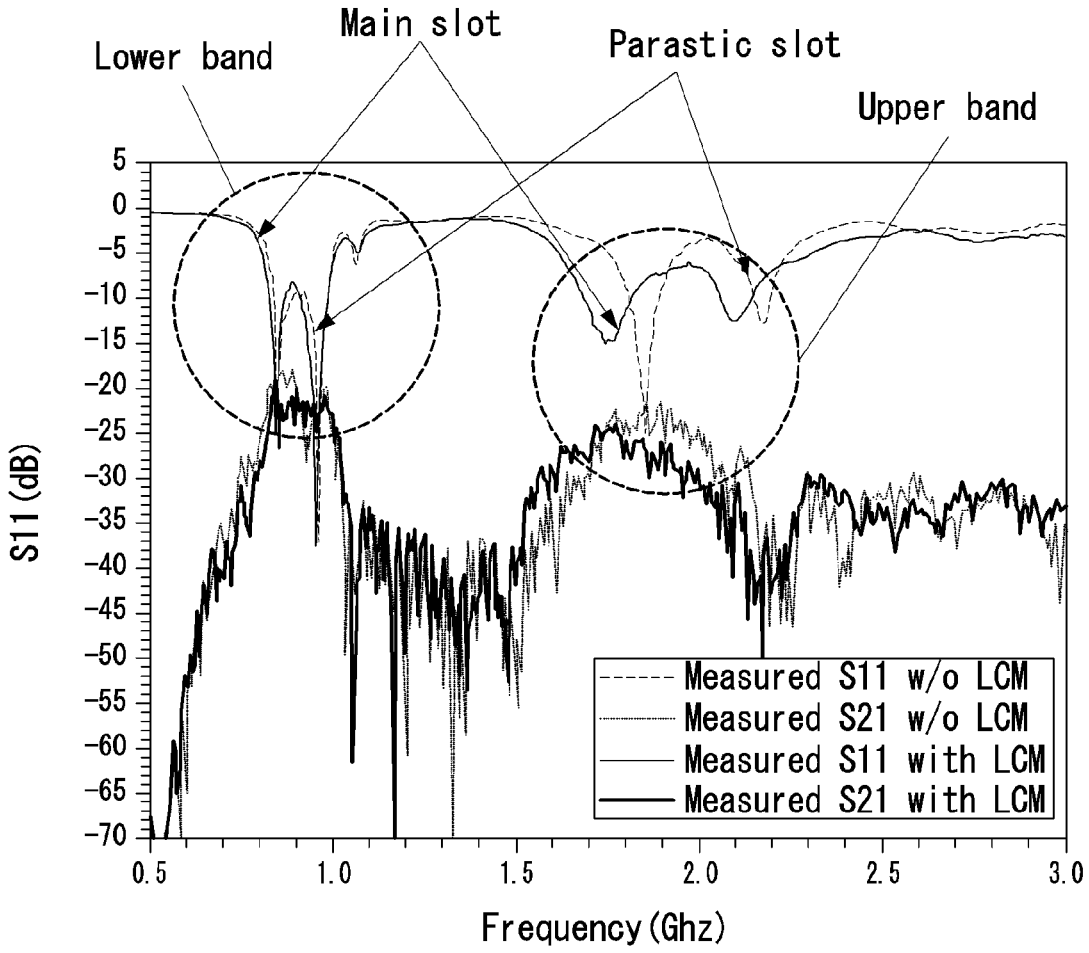
FIG. 5 shows measurement results of the reflection coefficient for the slot antenna of FIGS. 4*a* and 4*b;*

FIGS. 4*a* and 4*b* are views showing a slot antenna according to a first exemplary embodiment of the present invention. FIG. 5 shows measurement results of the reflection coefficient for the slot antenna of FIGS. 4*a* and 4*b*.

Referring to FIGS. 4*a* to 5, the slot antenna of this invention comprises a main slot 100, first and second parasitic slots 101 and 102, a coaxial cable 200, a feeding PCB 202, and a ground PCB 201.

The main slot 100 and the parasitic slots 101 and 102 each are formed on one or more sides at the corner and edge of a conductive housing 300. The lengths and shapes of the main slot 100 and the parasitic slots 101 and 102 may be modified in various ways depending on a desired operating frequency. For example, the main slot 100 and the parasitic slots 101 and 102 each are formed on one or more sides at the corner and edge of the conductive housing 300, and at least part of them may be bent.

As the lengths and shapes of the main slot 100 and the parasitic slots 101 and 102 vary based on the antenna's bandwidth, these slots are not limited to specific shapes.

The main slot 100 may be designed in such a way that it is formed along the corner and edge of the conductive housing 300 and divided into two parts, some of which extends to the end of a sidewall of the conductive housing 300. The main slot 100 is an antenna which is fed through the coaxial cable 200 and resonates at a frequency band desired by a designer. The main slot 100 is a slot that is designed to resonate in an upper band and a lower band, as shown in FIG. 5.

The main slot 100 is divided into two parts, which operate at different frequencies depending on which of the two parts current flows to. As the length of the main slot 100 affects the frequency at which the slot resonates, the lengths of the two parts are adjusted to allow the main slot 100 to operate as the main antenna in the upper band and the lower band, as shown in FIG. 5.

The first and second parasitic slots 101 and 102 are formed on two side edges and the bottom meeting at the corner of the conductive housing 300, with the main slot 100 interposed between them. The main slot 100 alone is not enough to give a wide bandwidth for the upper band and the lower band. The first and second parasitic slots 101 and 102 are subsidiary antennas which are added to widen the bandwidth in the upper and lower bands, respectively. The first parasitic slot 101 is formed on the edge of one side of the conductive housing 300 near the left side of the main slot 100. The first parasitic slot 101 resonates in the lower band and widens the bandwidth of the lower band, and controls the impedance matching for the lower band. The second parasitic slot 102 is formed on the edge of the other side of the conductive housing 300 near the right side of the main slot 100. The second parasitic slot 102 resonates in the upper band and widens the bandwidth of the upper band, and controls the impedance matching for the upper band.

The direction of electrical current flowing around the main slot 100 is changed by the parasitic slots 101 and 102, giving rise to an additional resonance in the parasitic slots 101 and 102. This change in current flow widens the bandwidth and changes the impedance matching characteristics. If the parasitic slots 101 and 102 are connected to the main slot 100, the parasitic slots 101 and 102 are absorbed into the main slot 100, thus failing to attain the effects of bandwidth expansion and impedance matching.

In FIG. 5, S11 denotes the reflection coefficient of the antenna. S11 w/o LCM denotes S11 which is measured when the liquid crystal display panel LCM is not present, and S11 with LCM denotes S11 which is measured when the liquid crystal display panel LCM is located close to the slot antenna of FIGS. 4*a* and 4*b*. S21 w/o LCM denotes S21 which is measured when the liquid crystal display panel LCM is not present, and S21 with LCM denotes S21 which is measured when the liquid crystal display panel LCM is located close to the slot antenna of FIGS. 4*a* and 4*b*.

S11 is usually represented in dB scale, which indicates how much input power is reflected back from the antenna. The closer to zero S11 goes, the more power is reflected back, and the further down from zero S11 goes, the less power is reflected back. Power that is not reflected back can be deemed as radiated through the antenna or lost as heat. As the designer will want the power of a signal in a desired frequency band to be all radiated from the antenna without coming back, it can be said that the less S11, the better the antenna performance. The frequency at which S11 is minimum is the resonance frequency of the antenna. The antenna operates at the resonance frequency. In general, the operating frequency band of the antenna is a frequency range in which S11 is not more than −6 dB.

If the slot antenna is located close to the display panel 16, the dielectric constant around the antenna changes due to the display panel 16. S21 is the measurement of how much power radiated from the slot antenna is received through a measurement antenna. Assuming that two different antennas 1 and 2 have an S11 value of −20 dB at a particular frequency, if the power measurements the measurement antenna make when the two antennas radiate power toward the measurement antenna are −5 dB (for the power sent from antenna 1) and −10 dB (for the power sent from antenna 2), respectively, it can be concluded that antenna 2 exhibits more loss than antenna 1. The present inventor measured S21 as an indicator of if less loss occurs at the resonance frequency of the antenna and if radio waves are properly radiated.

FIG. 6 is a table showing the frequency ranges of upper and lower bands of the slot antenna of FIGS. 4*a* and 4*b*. In FIG. 6, Case 1 shows when the upper band is designed as a single wide band (with a frequency range of 1,750 MHz to 2,140 MHz), and Case 2 shows when the upper band is designed as two bands (with a frequency range of 1,750 MHz to 1,950 MHz and a frequency range of 2,140 MHz, respectively). Since the test result showed that the design difficulty for Case 1 was high, the slot antenna of this invention was designed according to Case 2, as shown in FIG. 5.

Although the operating frequency of the slot antenna of this invention covers WWAN (GSM850, GSM900, GSM1800, GSM1900, and UMTS), as shown in FIG. 6, the present invention is not limited thereto. For example, the length of the main slot 100 can be adjusted so that the slot antenna operates in communication bands such as WCDMA, PCS, GSM, AMPS, UMTS, IMT-2000, GPS, WLAN, IMS, Bluetooth, Wibro, Wimax, Zigbee, and UWB.

Figure 7:
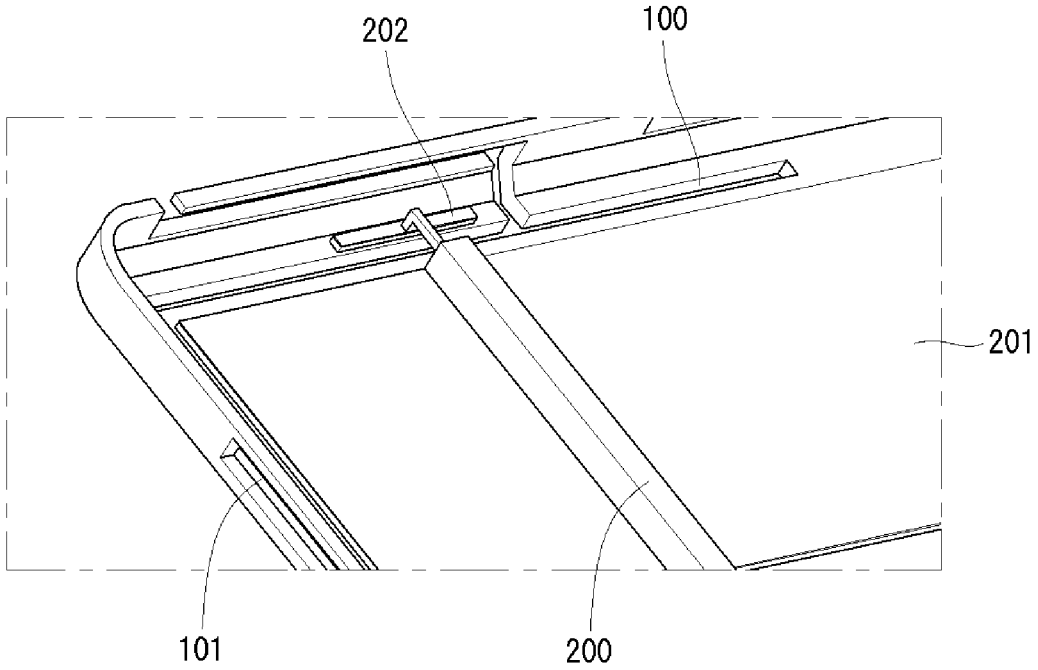
FIG. 7 is a perspective view showing a feeding method for the slot antenna of FIGS. 4*a* and 4*b;*

FIG. 7 is a perspective view showing a feeding method for the slot antenna of FIGS. 4*a* and 4*b*.

Referring to FIG. 7, one end of the coaxial cable 200 is connected to an RF module (not shown) that generates a high-frequency signal. The other end of the coaxial cable 200 is connected to the main slot 100 to feed the slot antenna. The coaxial cable 200 feeds a high-frequency signal to the center of the main slot 100 through the feeding PCB 202, without being directly connected to the conductive housing 300. The feeding PCB 202 is bonded to the surface of the conductive housing 300 above the center of the main slot 100. The feeding PCB 202 and the ground PCB 201 each comprise a dielectric substrate bonded to the conductive housing 300 and a copper plate coated on the surface of the substrate. The inner core of the coaxial cable 200 is connected to the feeding PCB 202, and the outer core of the coaxial cable 200 is connected to the ground PCB 201. The ground PCB 201 is much larger in size than the feeding PCB 202, and the copper plate on its surface serves as the ground of the coaxial cable. Such a feeding method is known as the coupling feeding method. The coupling feeding method is one of the methods used to design an antenna with a wide bandwidth. Coupling feeding is also known as capacitive feeding because a feeding structure (which is conductive and corresponds to the inner core of the coaxial cable) and a resonating structure (which corresponds to the slots in the conductive housing) are not connected directly to each other, but separated by the dielectric material to form a capacitance.

The capacitive elements of the feeding PCB 202 increase or decrease depending on the dimensions of the feeding PCB 202. As shown in FIG. 7, it is difficult to increase the width of the feeding PCB 202 due to the location of the main slot 100 and also difficult to decrease it because the feeding PCB 202 needs to be soldered to the coaxial cable 200. In contrast, the length of the feeding PCB 202 can be adjusted. If the length of the feeding PCB 202 is increased, the capacitance increases, and if the length of the feeding PCB 202 is decreased, the capacitance decreases. As the capacitance can be controlled as desired by using this physical property, impedance matching can be easily achieved by adjusting the length of the feeding PCB 202.

The parasitic slots operate by current flowing around the main slot, rather than being fed like the main slot. If the parasitic slots 101 and 102 are fed through another coaxial cable, the added coaxial cable increases manufacturing costs and makes the structure complicated, thus making it difficult for the information terminal apparatus to have a slim design. Also, it is necessary to add a switch so as to drive a different antenna at a different operating frequency each time the user changes its desired communication frequency. Accordingly, only the main slot 100, out of the slot antenna of this invention, is fed, but the parasitic slots 101 and 102 are not fed.

Figure 8A:
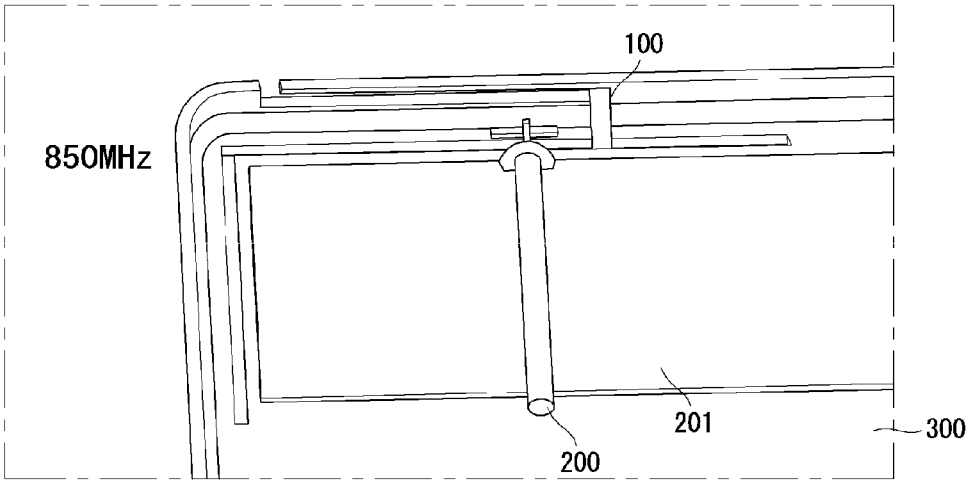
FIGS. 8*a* and 8*b* are views showing an operation of the main slot in the slot antenna of FIGS. 4*a* and 4*b;*
Figure 8B:
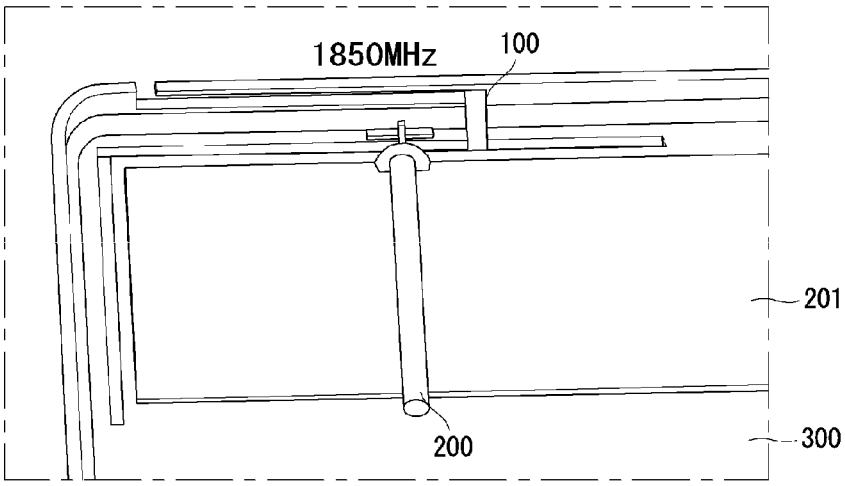

FIGS. 8*a* and 8*b* are views showing an operation of the main slot in the slot antenna of FIGS. 4*a* and 4*b*. The main slot 100 is divided into two parts. The operating frequency varies depending on which direction the current flowing along the main slot 100 goes in. As the lengths of the two parts of the main slot 100 affect the resonance frequency, the operating frequency can be controlled by adjusting their lengths so that the main slot 100 operates in desired upper and lower bands. In FIGS. 8*a* and 8*b*, the red portions indicate an 850 MHz frequency operating area and an 1850 MHz frequency operating area, respectively.

As discussed above, it is difficult to achieve a wide bandwidth in the upper and lower bands only by using the main slot 100, and the parasitic slots 101 and 102 are therefore added.

Figure 8C:
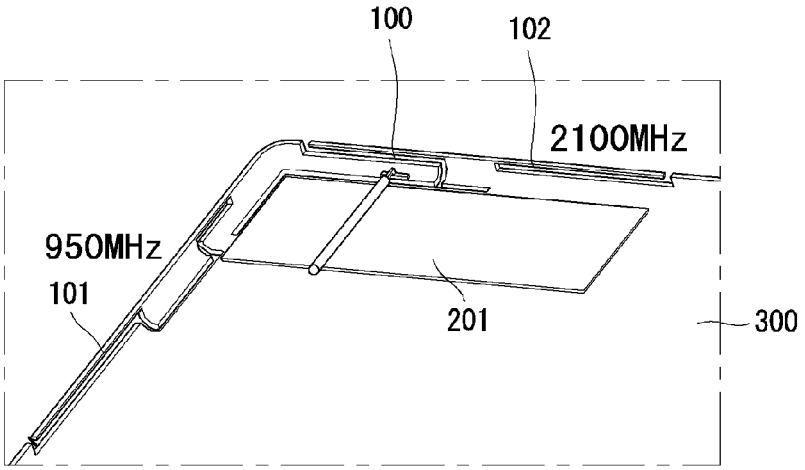
FIG. 8*c* is a view showing an operation of parasitic slots that are added to either side of the main slot.

FIG. 8*c* is a view showing an operation of parasitic slots that are added to either side of the main slot. As the lengths of the parasitic slots 101 and 102 affect the resonance frequency, their lengths should be properly chosen to provide a wide bandwidth in the upper band and the lower band, respectively. FIG. 8*c* illustrates an example in which the first parasitic slot 101 operates at 950 MHz frequency, and the second parasitic slot 102 operates at 2100 MHz frequency. The parasitic slots 101 and 102 may be designed to be bent for impedance matching.

Figure 9:
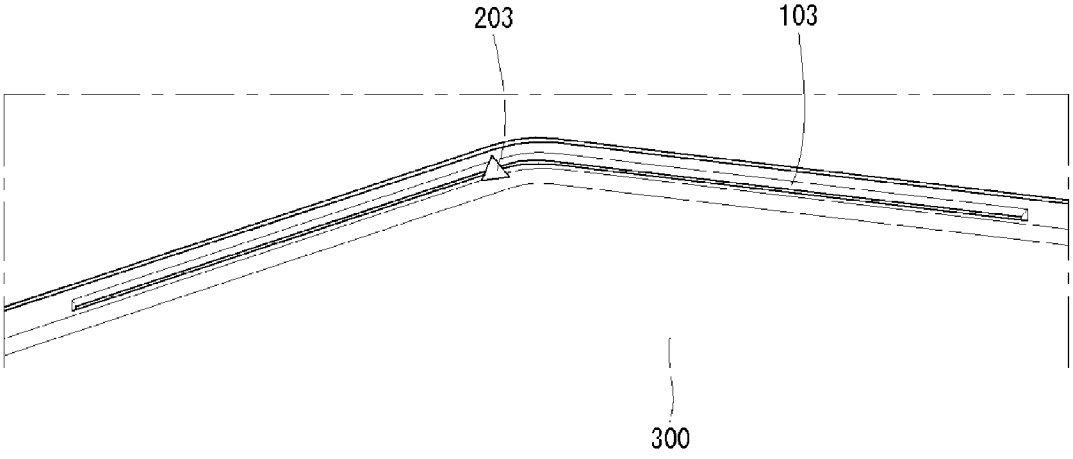
FIG. 9 is a view showing a slot antenna according to a second exemplary embodiment of the present invention.
Figure 10:
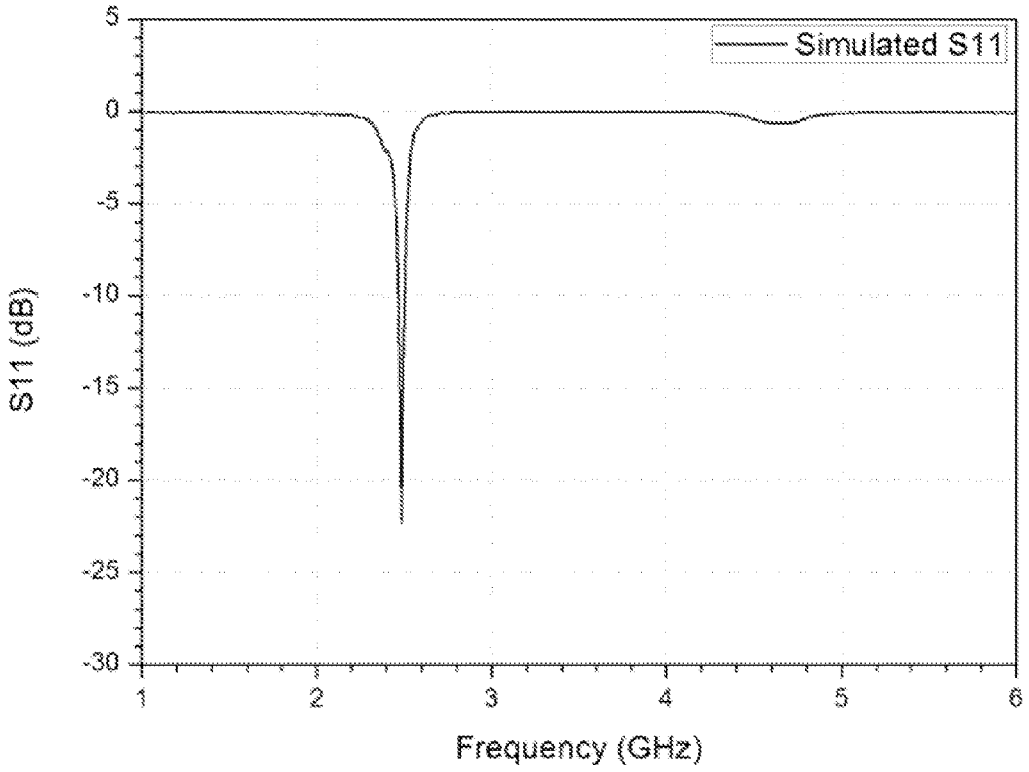
FIG. 10 is a graph showing measurement results of the reflection coefficient for the slot antenna of FIG. 9.

The slot antenna of this invention may be modified in various ways, as shown in FIGS. 9 and 10, to have a structure capable of minimizing the effect of the display panel and contributing to the slim design of the information terminal apparatus. For example, the parasitic slots may be omitted if a wide bandwidth is not required.

FIG. 9 is a view showing a slot antenna according to a second exemplary embodiment of the present invention. FIG. 10 is a graph showing measurement results of the reflection coefficient for the slot antenna of FIG. 9.

Referring to FIGS. 9 and 10, the slot antenna of this invention comprises a main slot 103 which is longitudinally formed along the corner of a conductive housing 300 and the edges on either side of the corner. The slot antenna has a narrow bandwidth, as shown in FIG. 10, because parasitic slots are omitted. Both ends of the main slot 103 are blocked, like those of a slot of a typical slot antenna. The feeding method used for the main slot 103 is the direct feeding method. Accordingly, the inner core of the coaxial cable is directly connected to the surface of the conductive housing 300 at a feeding position 203 in the center of the main slot 103. The feeding method for the main slot 103 is not limited to the above method. For example, the main slot 103 can be fed by the coupling feeding method, as shown in FIG. 7. By adjusting the length of the main slot 103, the resonance frequency changes like in the following exemplary embodiments.

Figure 11:
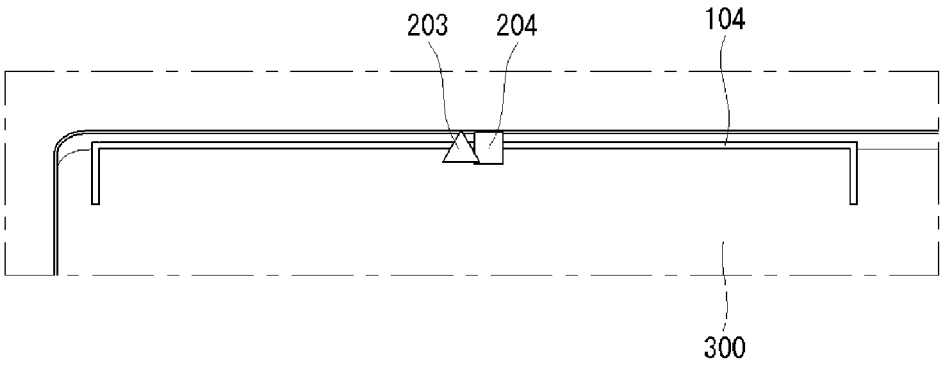
FIG. 11 is a view showing a slot antenna according to a third exemplary embodiment of the present invention.
Figure 12:
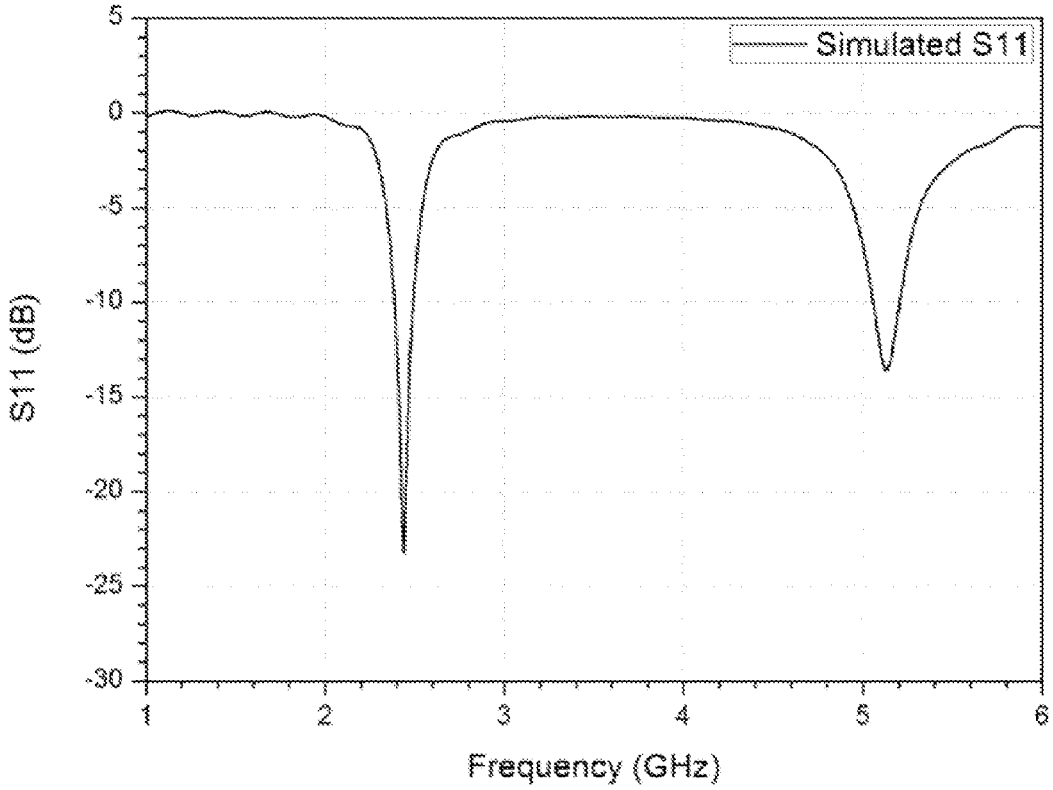
FIG. 12 is a graph showing measurement results of the reflection coefficient for the slot antenna of FIG. 11.

FIG. 11 is a view showing a slot antenna according to a third exemplary embodiment of the present invention. FIG. 12 is a graph showing measurement results of the reflection coefficient for the slot antenna of FIG. 11.

Referring to FIGS. 11 and 12, the slot antenna of this invention comprises a main slot 104 which is longitudinally formed on the edge of one side of a conductive housing 300. Both ends of the main slot 104 extend to the bottom surface of the conductive housing 300. The slot antenna has no parasitic slots. Both ends of the main slot 104 are blocked, like those of a slot of a typical slot antenna. The feeding method used for the main slot 104 is the direct feeding method. Accordingly, the inner core of the coaxial cable is directly connected to the surface of the conductive housing 300 at a feeding position 203 in the center of the main slot 104. The feeding method for the main slot 104 is not limited to the above method. For example, the main slot 104 can be fed by the coupling feeding method, as shown in FIG. 7. In FIG. 11, reference numeral 204 denotes an impedance matching circuit comprising an inductor L and a capacitor C element. The impedance matching circuit 204 can be mounted on a feeding PCB 202 which is bonded to the conductive housing 300 at the feeding position 203.

Figure 13:
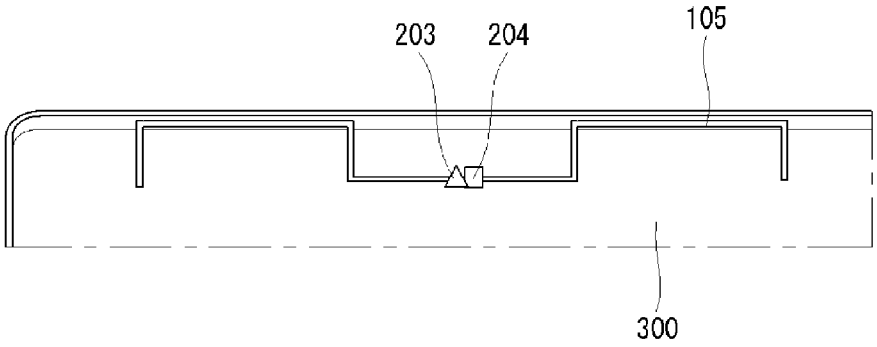
FIG. 13 is a view showing a slot antenna according to a fourth exemplary embodiment of the present invention.
Figure 14:
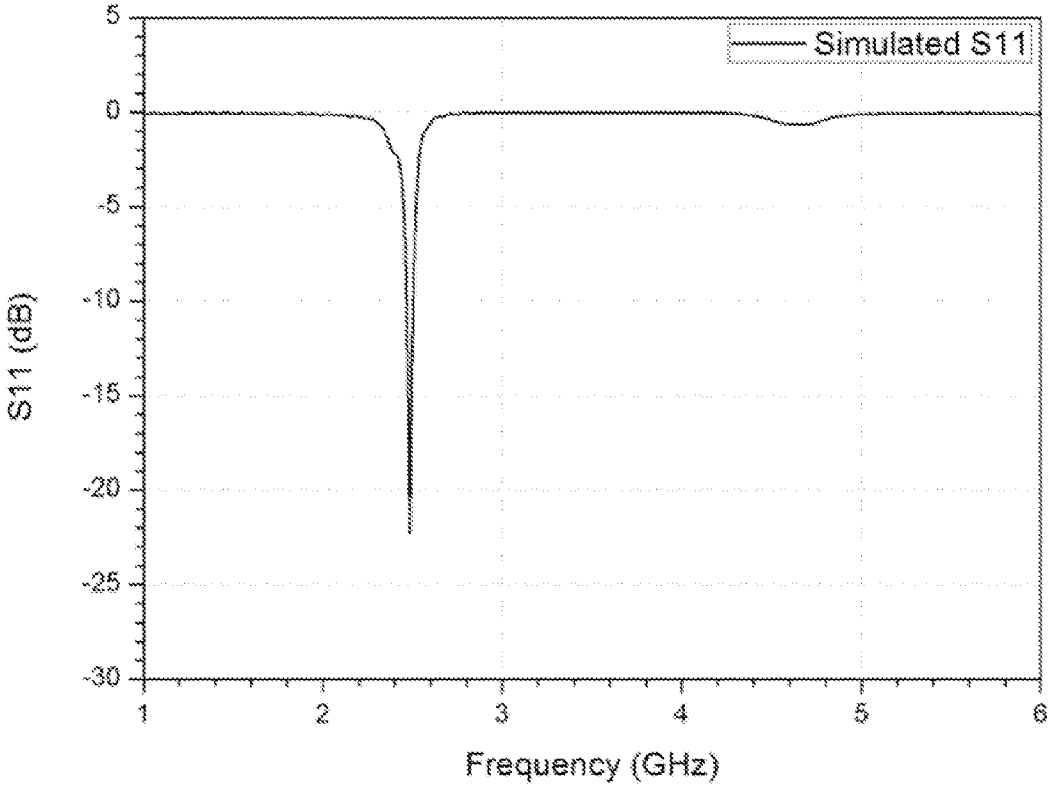
FIG. 14 is a graph showing measurement results of the reflection coefficient for the slot antenna of FIG. 13.

FIG. 13 is a view showing a slot antenna according to a fourth exemplary embodiment of the present invention. FIG. 14 is a graph showing measurement results of the reflection coefficient for the slot antenna of FIG. 13.

Referring to FIGS. 13 and 14, the slot antenna of this invention comprises a main slot 105 which is longitudinally formed on the edge of one side of a conductive housing 300. At least part of the main slot 105 may be bent so that the main slot 105 is sufficiently long along the edge of the conductive housing 300 of the main slot 105. In FIG. 13, the main slot 105 is formed in a raised and depressed fashion, and its central part and both ends extend to the bottom surface of the conductive housing 300. The slot antenna has no parasitic slots. Both ends of the main slot 105 are blocked, like those of a slot of a typical slot antenna. The feeding method used for the main slot 105 is the direct feeding method. Accordingly, the inner core of the coaxial cable is directly connected to the surface of the conductive housing 300 at a feeding position 203 in the center of the main slot 105. The feeding method for the main slot 105 is not limited to the above method. For example, the main slot 105 can be fed by the coupling feeding method, as shown in FIG. 7. The impedance matching circuit 204 can be mounted on a feeding PCB 202 which is bonded to the conductive housing 300 at the feeding position 203.

Figure 15:
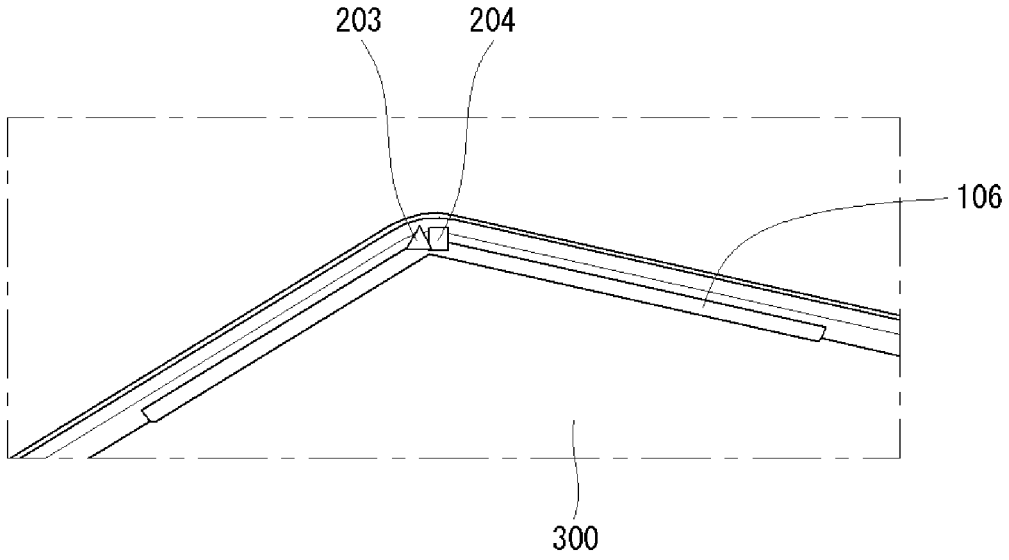
FIG. 15 is a view showing a slot antenna according to a fifth exemplary embodiment of the present invention.
Figure 16:
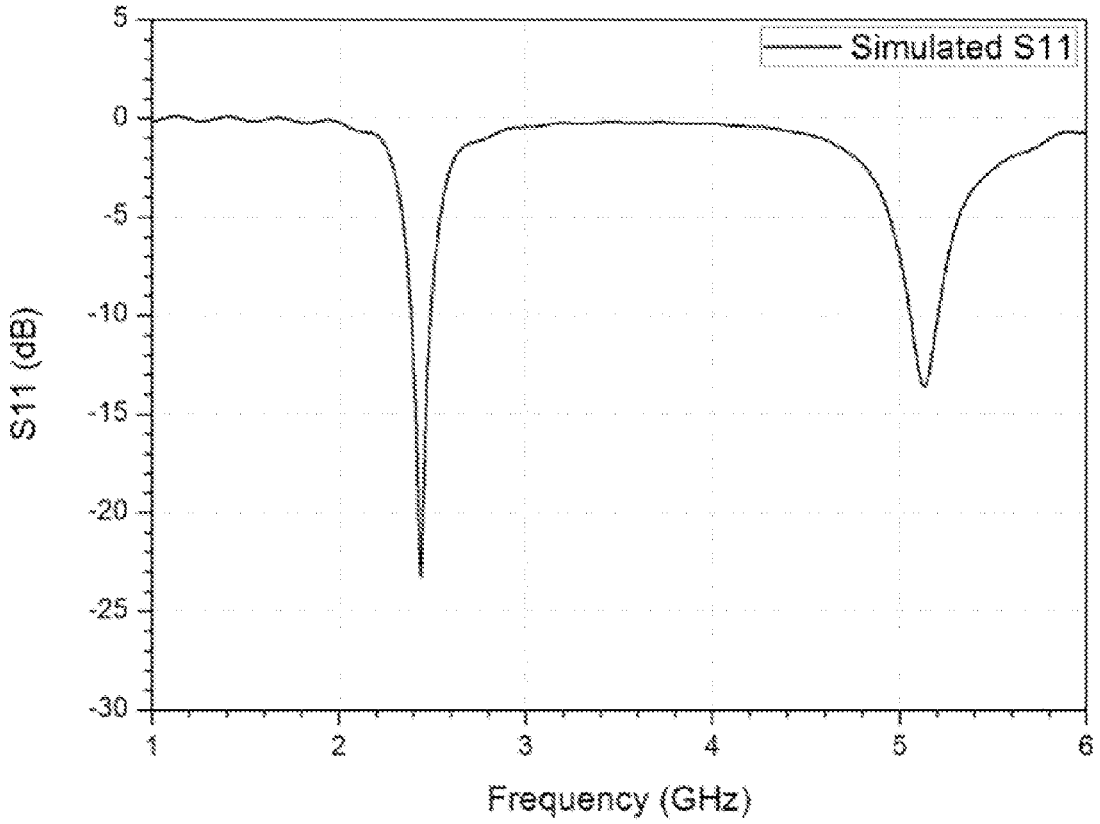
FIG. 16 is a graph showing measurement results of the reflection coefficient for the slot antenna of FIG. 15.

FIG. 15 is a view showing a slot antenna according to a fifth exemplary embodiment of the present invention. FIG. 16 is a graph showing measurement results of the reflection coefficient for the slot antenna of FIG. 15.

Referring to FIGS. 15 and 16, the slot antenna of this invention comprises a main slot 106 which is longitudinally formed along the corner of a conductive housing 300 and the edges on either side of the corner. The slot antenna has no parasitic slots. Both ends of the main slot 106 are blocked, like those of a slot of a typical slot antenna. The feeding method used for the main slot 106 is the direct feeding method. Accordingly, the inner core of the coaxial cable is directly connected to the surface of the conductive housing 300 at a feeding position 203 in the center of the main slot 106. The feeding method for the main slot 106 is not limited to the above method. For example, the main slot 106 can be fed by the coupling feeding method, as shown in FIG. 7. The impedance matching circuit 204 can be mounted on a feeding PCB 202 which is bonded to the conductive housing 300 at the feeding position 203.

Figure 17:
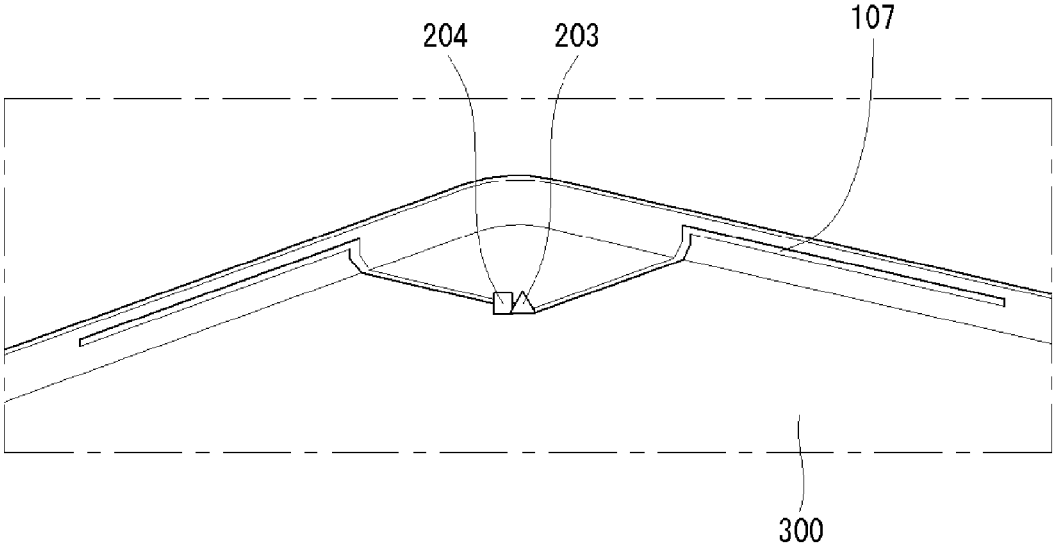
FIG. 17 is a view showing a slot antenna according to a sixth exemplary embodiment of the present invention.
Figure 18:
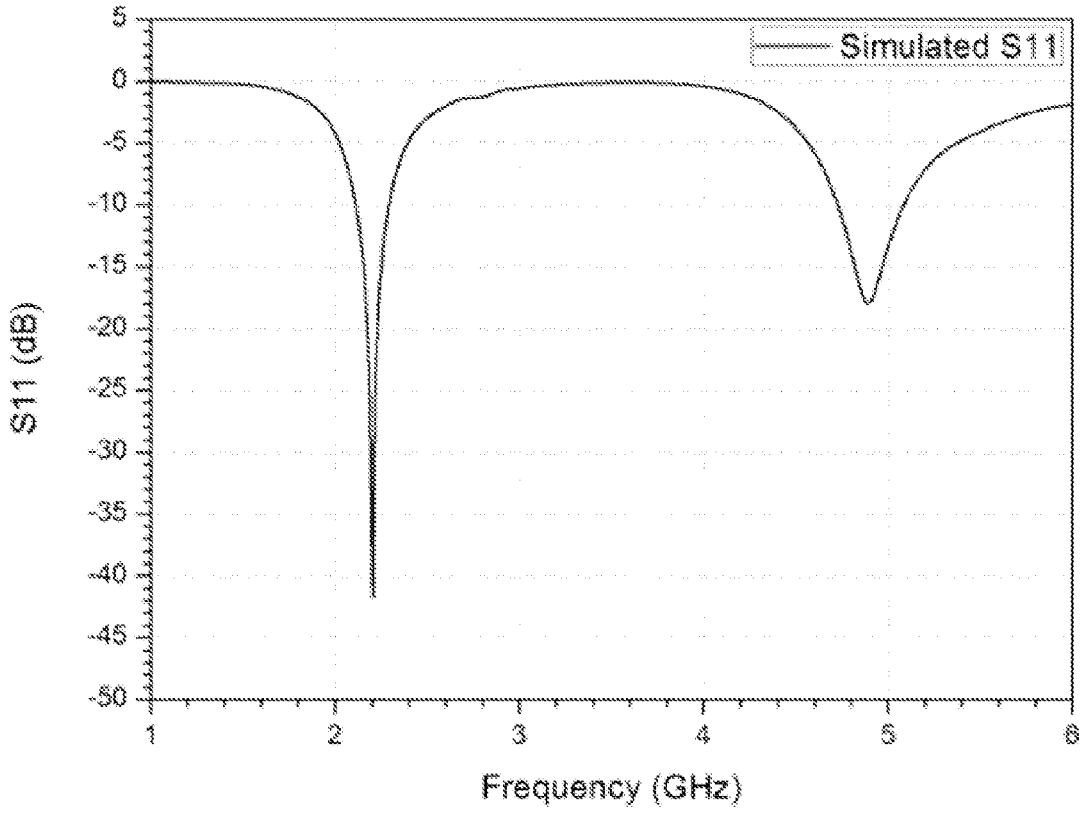
FIG. 18 is a graph showing measurement results of the reflection coefficient for the slot antenna of FIG. 17.

FIG. 17 is a view showing a slot antenna according to a sixth exemplary embodiment of the present invention. FIG. 18 is a graph showing measurement results of the reflection coefficient for the slot antenna of FIG. 17.

Referring to FIGS. 17 and 18, the slot antenna of this invention comprises a main slot 107 which is longitudinally formed along the corner of a conductive housing 300 and the edges on either side of the corner. The central part of the main slot 107 extends to the bottom surface of the conductive housing 300. The slot antenna has no parasitic slots. Both ends of the main slot 107 are blocked, like those of a slot of a typical slot antenna. The feeding method used for the main slot 107 is the direct feeding method. Accordingly, the inner core of the coaxial cable is directly connected to the surface of the conductive housing 300 at a feeding position 203 in the middle of the main slot 107. The feeding method for the main slot 107 is not limited to the above method. For example, the main slot 107 can be fed by the coupling feeding method, as shown in FIG. 7. The impedance matching circuit 204 can be mounted on a feeding PCB 202 which is bonded to the conductive housing 300 at the feeding position 203.

Figure 19:
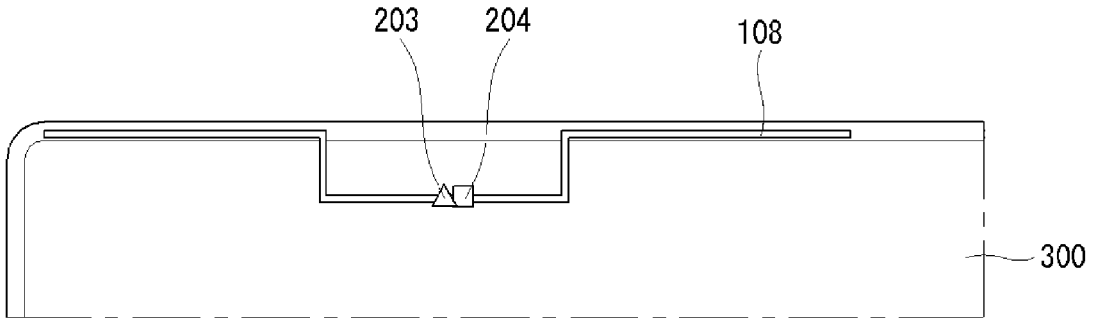
FIG. 19 is a view showing a slot antenna according to a seventh exemplary embodiment of the present invention.
Figure 20:
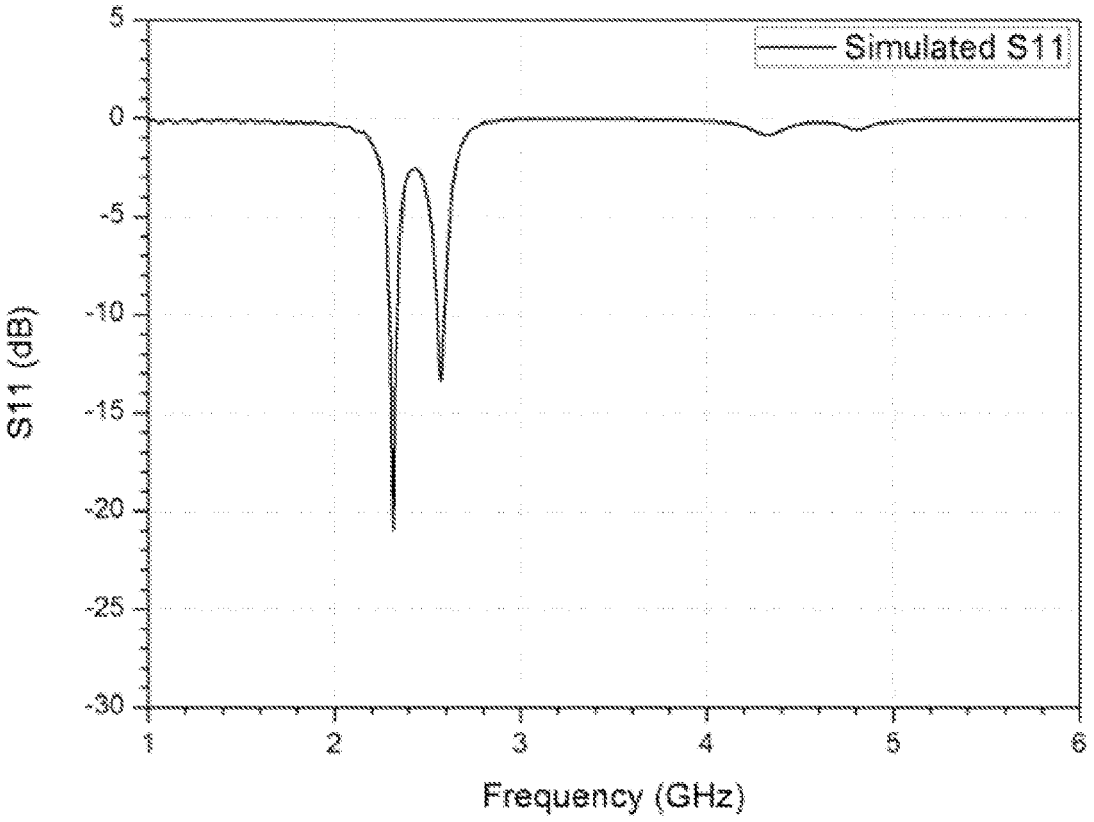
FIG. 20 is a graph showing measurement results of the reflection coefficient for the slot antenna of FIG. 19.

FIG. 19 is a view showing a slot antenna according to a seventh exemplary embodiment of the present invention. FIG. 20 is a graph showing measurement results of the reflection coefficient for the slot antenna of FIG. 19.

Referring to FIGS. 19 and 20, the slot antenna of this invention comprises a main slot 108 which is longitudinally formed on the edge of one side of a conductive housing 300. The central part of the main slot 108 extends to the bottom surface of the conductive housing 300. The slot antenna has no parasitic slots. Both ends of the main slot 108 are blocked, like those of a slot of a typical slot antenna. The feeding method used for the main slot 108 is the direct feeding method. Accordingly, the inner core of the coaxial cable is directly connected to the surface of the conductive housing 300 at a feeding position 203 in the middle of the main slot 108. The feeding method for the main slot 108 is not limited to the above method. For example, the main slot 108 can be fed by the coupling feeding method, as shown in FIG. 7. The impedance matching circuit 204 can be mounted on a feeding PCB 202 which is bonded to the conductive housing 300 at the feeding position 203.

Figure 21:
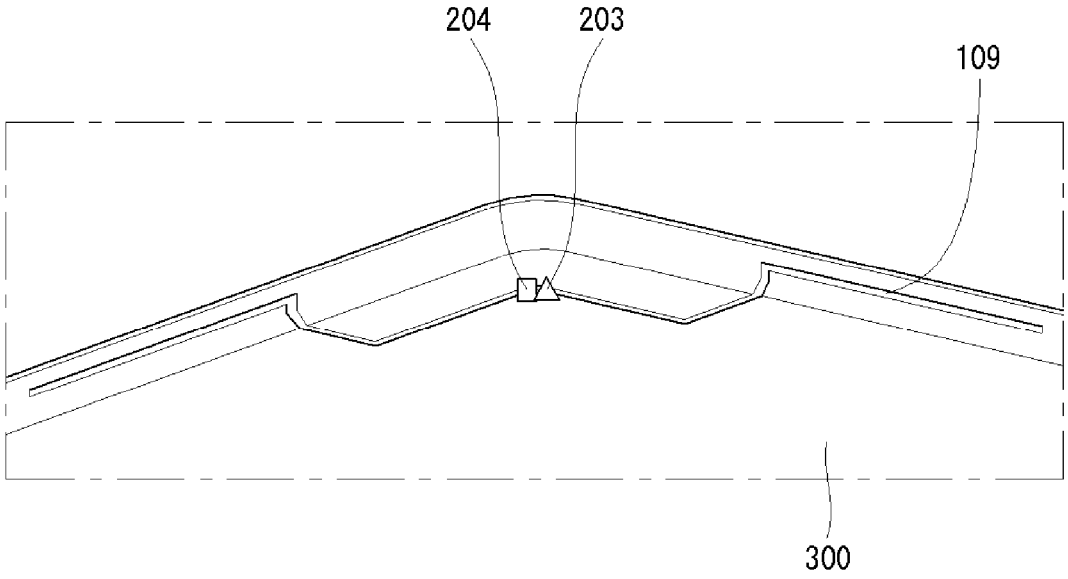
FIG. 21 is a view showing a slot antenna according to an eighth exemplary embodiment of the present invention.
Figure 22:
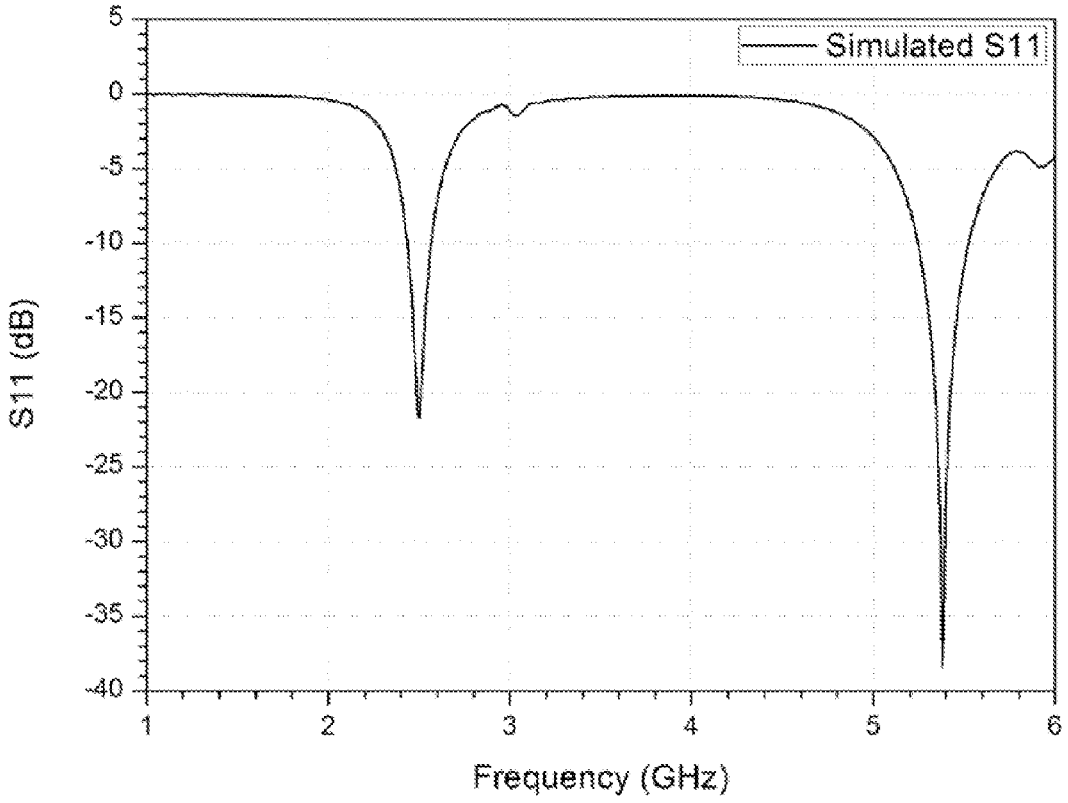
FIG. 22 is a graph showing measurement results of the reflection coefficient for the slot antenna of FIG. 21.

FIG. 21 is a view showing a slot antenna according to an eighth exemplary embodiment of the present invention. FIG. 22 is a graph showing measurement results of the reflection coefficient for the slot antenna of FIG. 21.

Referring to FIGS. 21 and 22, the slot antenna of this invention comprises a main slot 109 which is longitudinally formed along the corner of a conductive housing 300 and the edges on either side of the corner. The central part of the main slot 109 extends to the bottom surface of the conductive housing 300, and is bent three times. The slot antenna has no parasitic slots. Both ends of the main slot 109 are blocked, like those of a slot of a typical slot antenna. The feeding method used for the main slot 109 is the direct feeding method. Accordingly, the inner core of the coaxial cable is directly connected to the surface of the conductive housing 300 at a feeding position 203 in the middle of the main slot 109. The feeding method for the main slot 109 is not limited to the above method. For example, the main slot 109 can be fed by the coupling feeding method, as shown in FIG. 7. The impedance matching circuit 204 can be mounted on a feeding PCB 202 which is bonded to the conductive housing 300 at the feeding position 203.

The slot antennas illustrated in FIGS. 9 to 22 are typical slot antennas in which both ends of the main slot are blocked. As can be seen from the figures presenting the measurement results of the reflection coefficient, the slot antennas illustrated in FIGS. 9, 11, 15, 17, and 21 firstly resonate at approximately 2.5 GHz, and secondly resonate at a frequency from 4 to 5.2 GHz, which is about twice the primary resonance frequency. However, when a beam is divided into two parts, radiation rarely occurs between the divided beam parts. Moreover, these beam parts cannot communicate with each other using the secondary resonance frequency because it is difficult to control the primary resonance frequency and the secondary resonance frequency, individually. In order to perform communication in the secondary resonance frequency band, another antenna that operates in this frequency band should be added, or the length and shape of the main slot should be designed to give rise to the same resonance as the primary resonance. The secondary resonance frequency is not exactly twice the primary resonance frequency and the slot antennas illustrated in FIGS. 9, 11, 15, 17, and 21 have different secondary resonance frequencies, because the main slots have different lengths and structures. It was confirmed that the resonance frequencies for the slot antennas illustrated in FIGS. 13 and 17 were very low. Accordingly, if noise in the 4 to 5 GHz band needs to be reduced in the information terminal apparatus, the slot antennas of FIGS. 13 and 17 are highly useful. Although the slot antenna of FIG. 17 resonates twice at 2.2 GHz and 2.4 GHz, respectively, the resonance at 2.4 GHz cannot be called the secondary resonance because 2.4 GHz is not twice as high as the resonance frequency of 2.2 GHz. If a structure, e.g., parasitic slots, capable of giving rise to an additional resonance between 2.2 GHz and 2.4 GHz, is added to the slot antenna of FIG. 17, wide bandwidth can be achieved.

Figure 23:
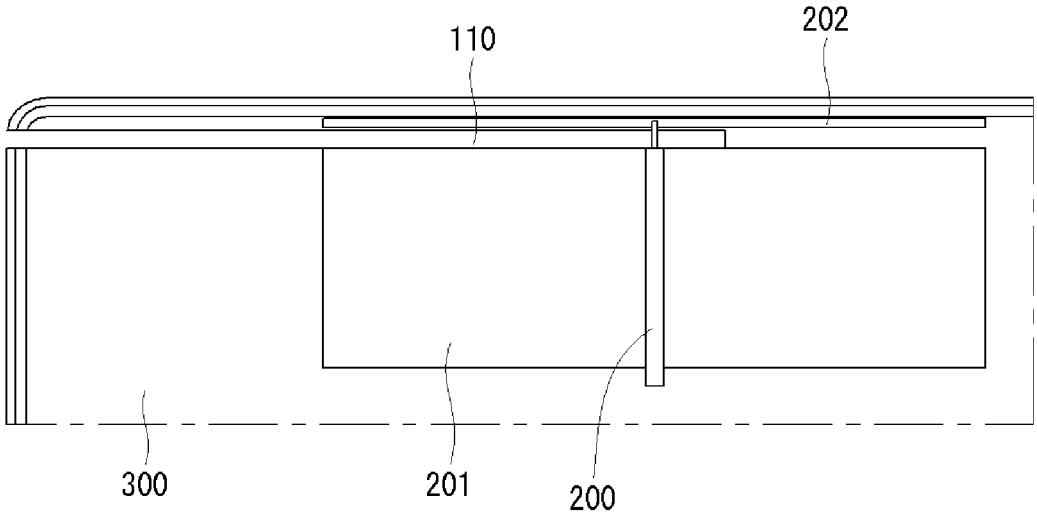
FIG. 23 is a view showing a slot antenna according to a ninth exemplary embodiment of the present invention.
Figure 24:
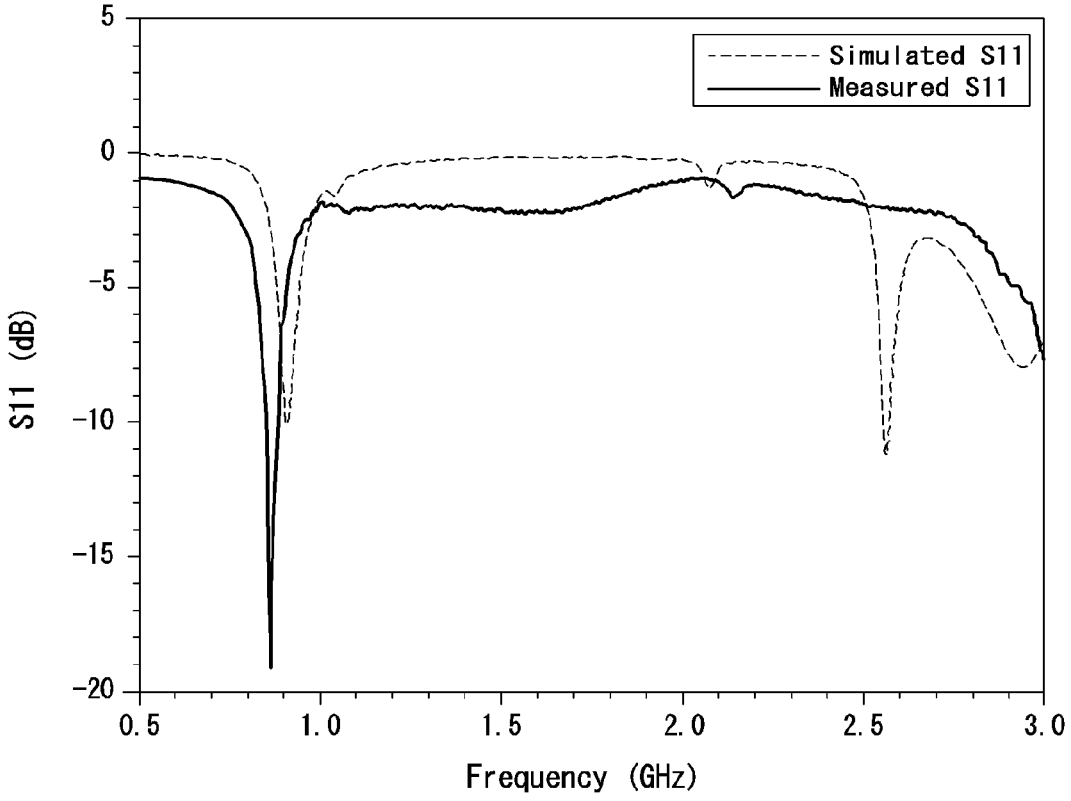
FIG. 24 is a graph showing measurement results of the reflection coefficient for the slot antenna of FIG. 23.

FIG. 23 is a view showing a slot antenna according to a ninth exemplary embodiment of the present invention. FIG. 24 is a graph showing measurement results of the reflection coefficient for the slot antenna of FIG. 23.

Referring to FIGS. 23 and 24, the slot antenna of this invention comprises a main slot 110 which is longitudinally formed in a straight line along the corner of a conductive housing 300 and the edge of one side of the conductive housing 300. One end of the main slot 110 is blocked, and the other end of the main slot 110 extends to the end of the conductive housing 300 and is open. The feeding method used for the main slot 110 is the coupling feeding method of FIG. 7 or the direct feeding method. The inner core of the coaxial cable 200 is connected to the feeding PCB 202. For impedance matching control, the feeding PCB 202 may be longitudinally formed to control the capacitance to a large extent, as shown in FIG. 23. The impedance matching circuit 204 (not shown) can be mounted on a feeding PCB 202 which is bonded to the conductive housing 300 at the feeding position 203.

Figure 25:
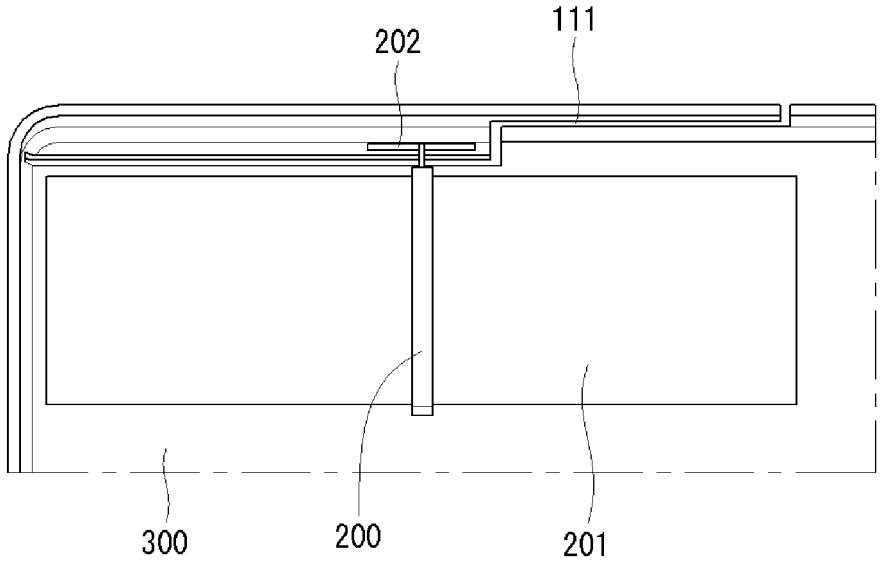
FIG. 25 is a view showing a slot antenna according to a tenth exemplary embodiment of the present invention.
Figure 26:
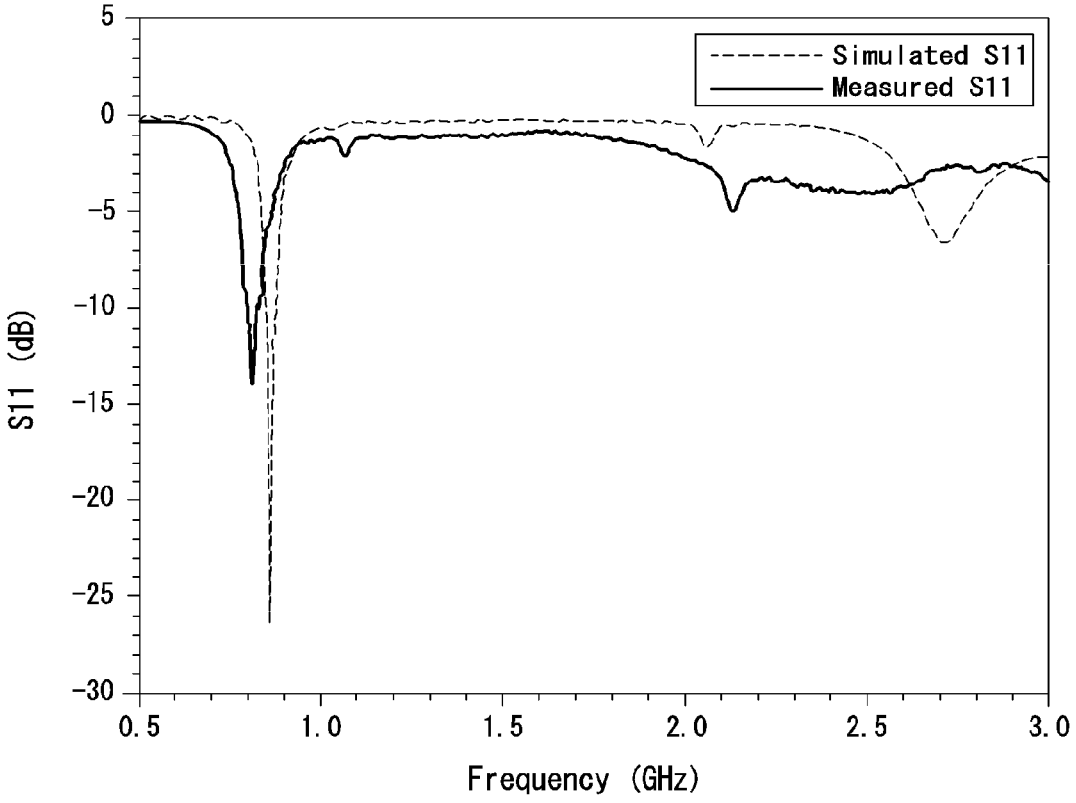
FIG. 26 is a graph showing measurement results of the reflection coefficient for the slot antenna of FIG. 25.

FIG. 25 is a view showing a slot antenna according to a tenth exemplary embodiment of the present invention. FIG. 26 is a graph showing measurement results of the reflection coefficient for the slot antenna of FIG. 25.

Referring to FIGS. 25 and 26, the slot antenna of this invention comprises a main slot 111 which is longitudinally formed along the corner of a conductive housing 300 and the edge of one side of the conductive housing 300. The main slot 111 is bent midway and formed on the bottom and one side of the conductive housing 300. One end of the main slot 111 is blocked, and the other end of the main slot 111 extends to the end of the conductive housing 300 and is open. The feeding method used for the main slot 111 is the coupling feeding method of FIG. 7 or the direct feeding method. The inner core of the coaxial cable 200 is connected to the feeding PCB 202. The impedance matching circuit 204 (not shown) can be mounted on a feeding PCB 202 which is bonded to the conductive housing 300 at the feeding position 203.

Figure 27:
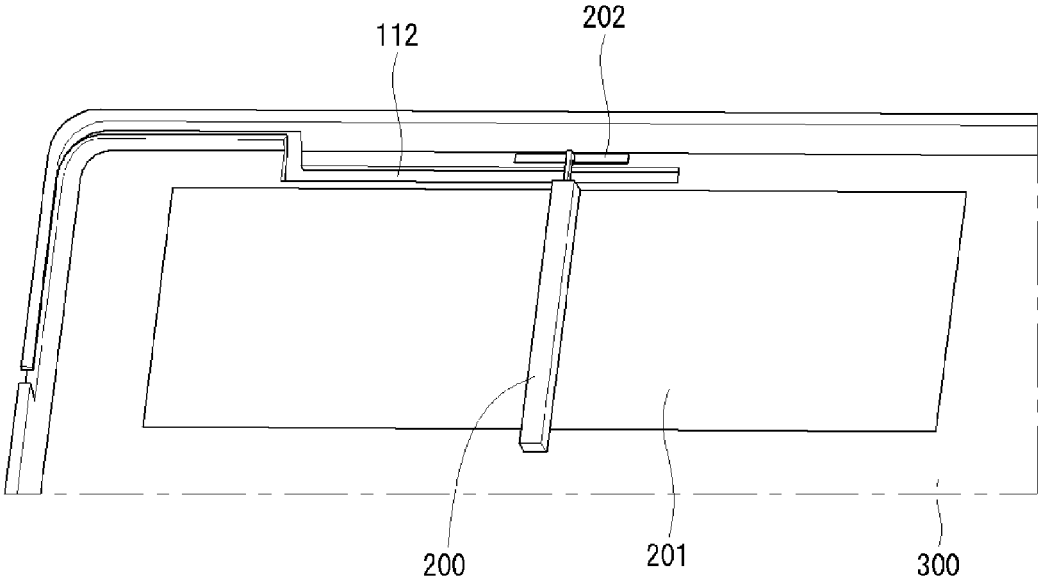
FIG. 27 is a view showing a slot antenna according to an eleventh exemplary embodiment of the present invention.
Figure 28:
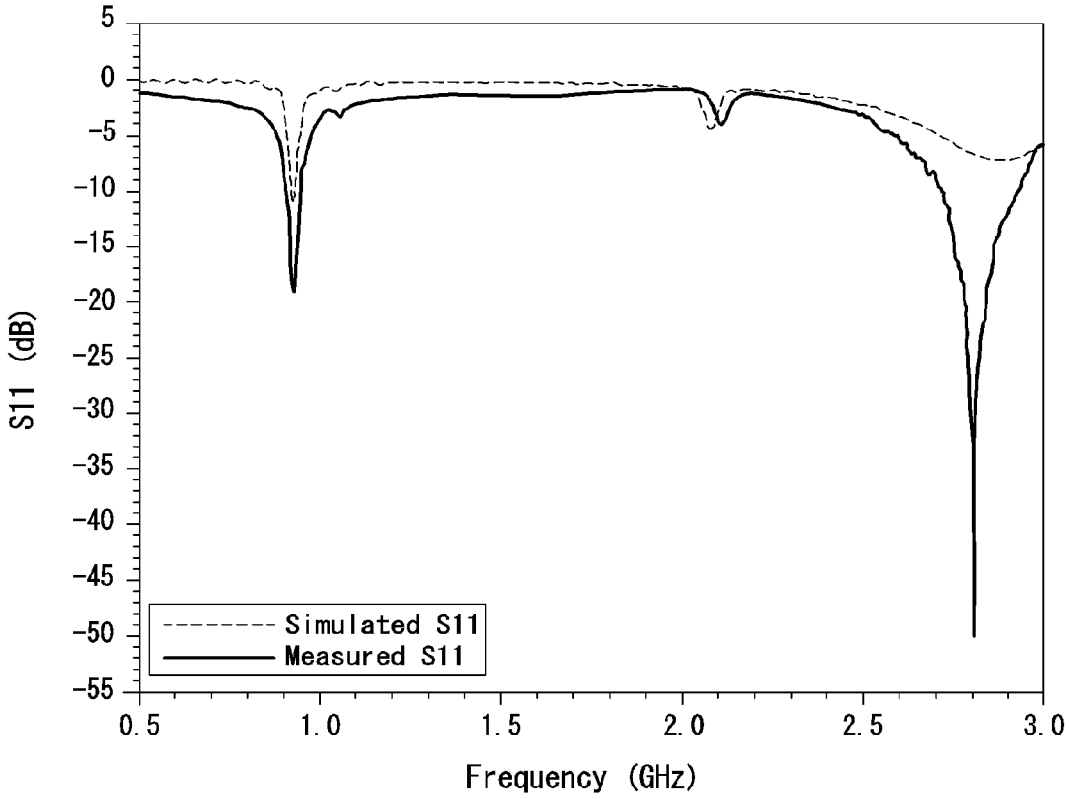
FIG. 28 is a graph showing measurement results of the reflection coefficient for the slot antenna of FIG. 27.

FIG. 27 is a view showing a slot antenna according to an eleventh exemplary embodiment of the present invention. FIG. 28 is a graph showing measurement results of the reflection coefficient for the slot antenna of FIG. 27.

Referring to FIGS. 27 and 28, the slot antenna of this invention comprises a main slot 112 which is formed along the corner of a conductive housing 300 and the edges on either side of the corner. The main slot 112 is bent midway and formed on the bottom and one side of the conductive housing 300 near the corner of the conductive housing 300. One end of the main slot 112 is blocked, and the other end of the main slot 112 extends to the end of the conductive housing 300 and is open. The feeding method used for the main slot 112 is the coupling feeding method of FIG. 7 or the direct feeding method. The inner core of the coaxial cable 200 is connected to the feeding PCB 202. The impedance matching circuit 204 (not shown) can be mounted on a feeding PCB 202 which is bonded to the conductive housing 300 at the feeding position 203.

Figure 29:
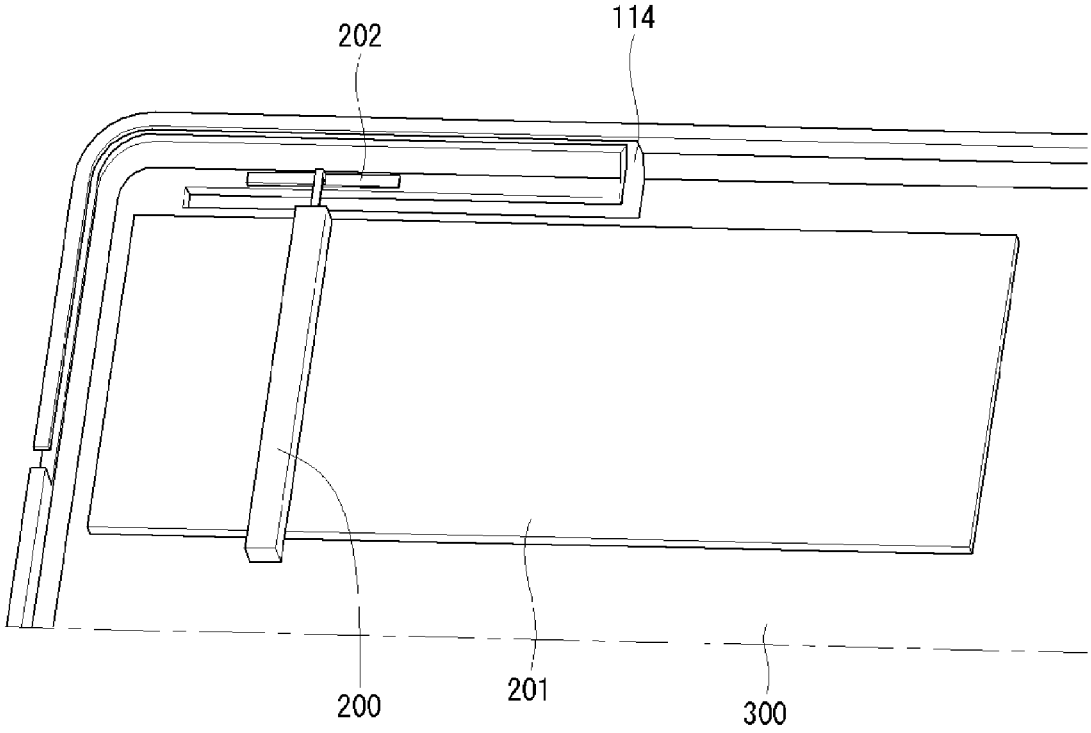
FIG. 29 is a view showing a slot antenna according to a twelfth exemplary embodiment of the present invention.

FIG. 29 is a view showing a slot antenna according to a twelfth exemplary embodiment of the present invention.

Figure 30:
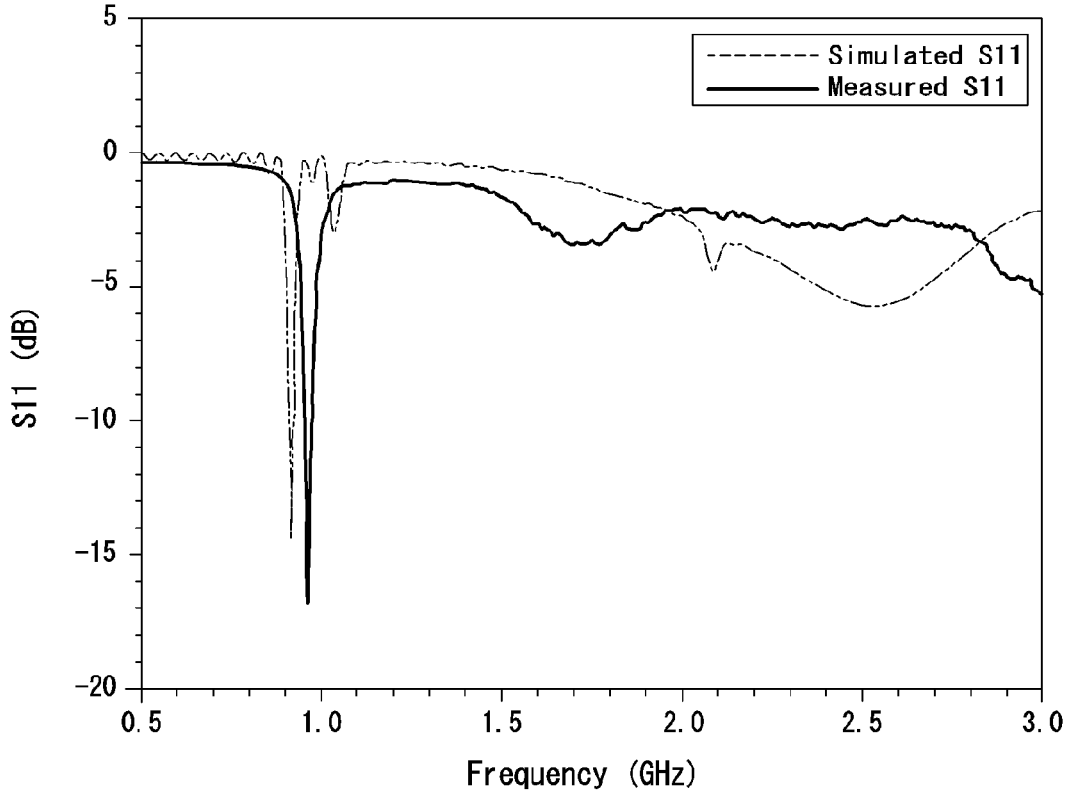
FIG. 30 is a graph showing measurement results of the reflection coefficient for the slot antenna of FIG. 29.

FIG. 30 is a graph showing measurement results of the reflection coefficient for the slot antenna of FIG. 29.

Referring to FIGS. 29 and 30, the slot antenna of this invention comprises a main slot 114 which is formed to around along the corner of a conductive housing 300 and the edges on either side of the corner. The main slot 114 is formed on the bottom and either side of the conductive housing 300 near the corner of the conductive housing 300 in such a way that it is bent midway and wraps around the corner. One end of the main slot 114 is blocked, and the other end of the main slot 114 extends to the end of the conductive housing 300 and is open. The feeding method used for the main slot 114 is the coupling feeding method of FIG. 7 or the direct feeding method. The inner core of the coaxial cable 200 is connected to the feeding PCB 202. The impedance matching circuit 204 (not shown) can be mounted on a feeding PCB 202 which is bonded to the conductive housing 300 at the feeding position 203.

The slot antennas shown in FIGS. 23 through 30 have a monopole or open structure in which one end is blocked and the other end is open. The main slot and parasitic slots shown in FIGS. 4*a* and 4*b* also have a monopole slot structure in which one end is blocked and the other end is open. The slots should be quite long in order to design an antenna that resonates in the lower band. If the other end of the slots is open, it enables a resonance in the lower band in a similar way to making the slots longer. As such, the slots can be made substantially shorter. Although the slot antennas having a monopole slot structure shown in FIGS. 23 through 30 operate in the lower band, their bandwidth is relatively narrow.

Figure 31:
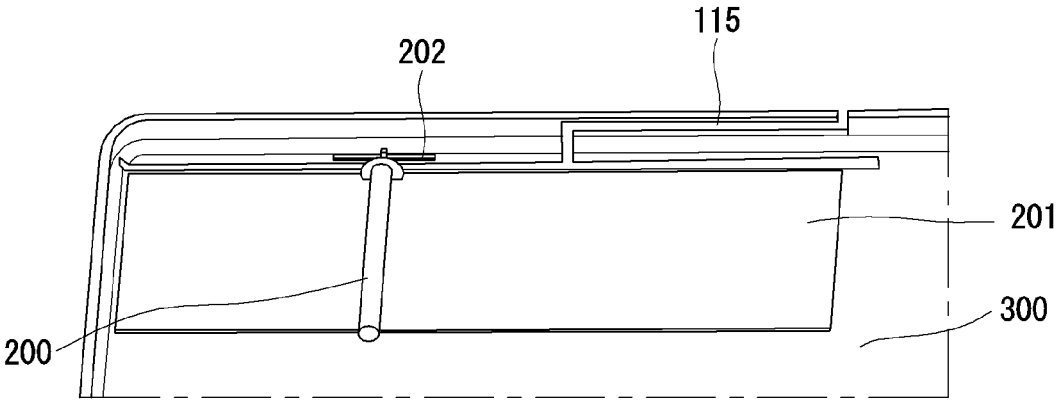
FIG. 31 is a view showing a slot antenna according to a thirteenth exemplary embodiment of the present invention.
Figure 32:
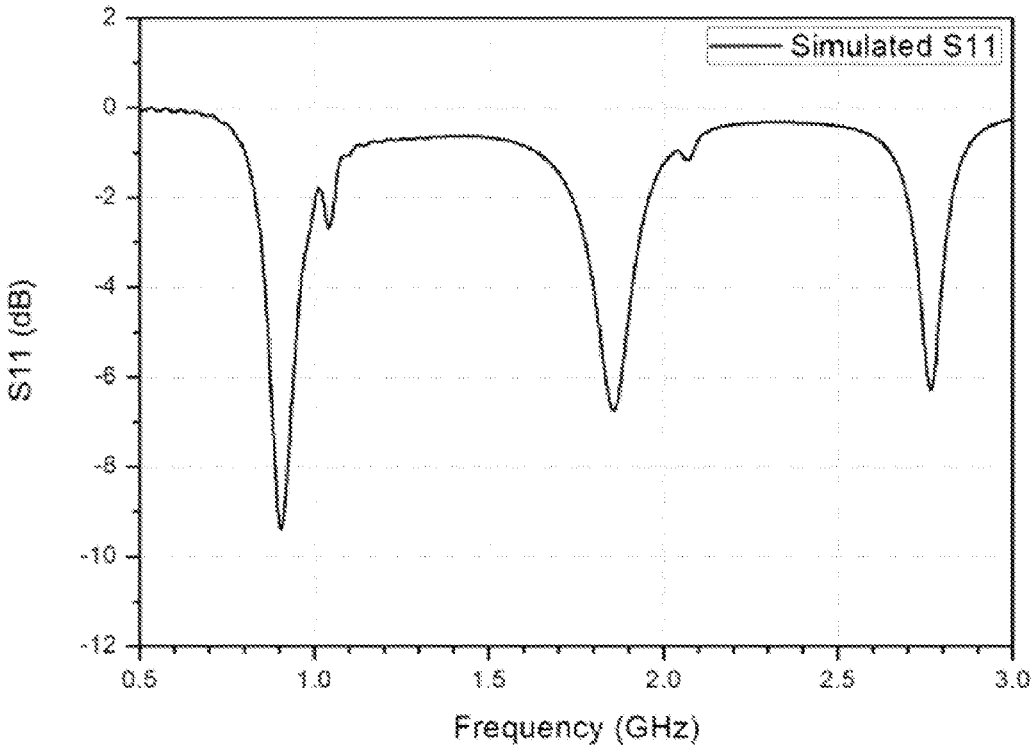
FIG. 32 is a graph showing measurement results of the reflection coefficient for the slot antenna of FIG. 31.

FIG. 31 is a view showing a slot antenna according to a thirteenth exemplary embodiment of the present invention. FIG. 32 is a graph showing measurement results of the reflection coefficient for the slot antenna of FIG. 31.

Referring to FIGS. 31 and 32, the slot antenna of this invention comprises a main slot 115 which is longitudinally formed along the corner of a conductive housing 300 and the edge of one side of the conductive housing 300 and divided into two parts. Any one of the two parts divided from the main slot 115 is open. The feeding method used for the main slot 115 is the coupling feeding method of FIG. 7 or the direct feeding method. The inner core of the coaxial cable 200 is connected to the feeding PCB 202. The impedance matching circuit 204 (not shown) can be mounted on a feeding PCB 202 which is bonded to the conductive housing 300 at the feeding position 203.

Figure 33:
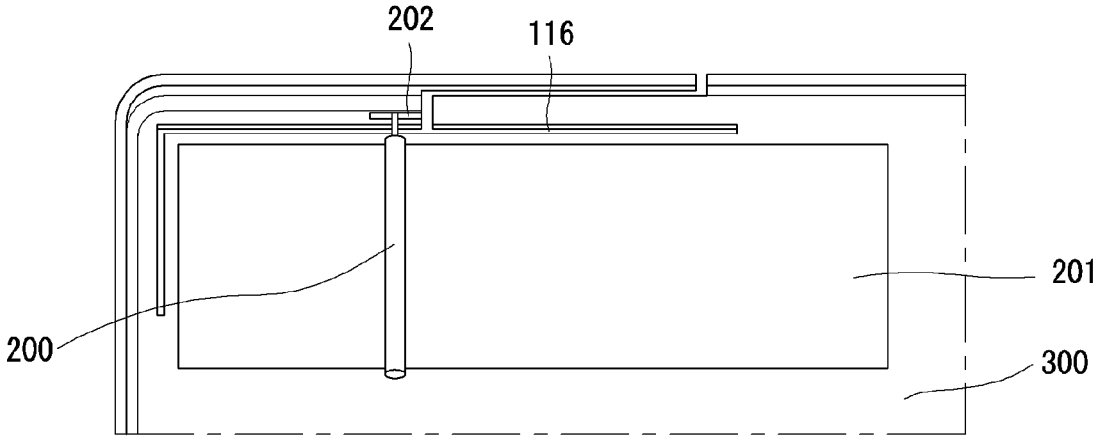
FIG. 33 is a view showing a slot antenna according to a fourteenth exemplary embodiment of the present invention.
Figure 34:
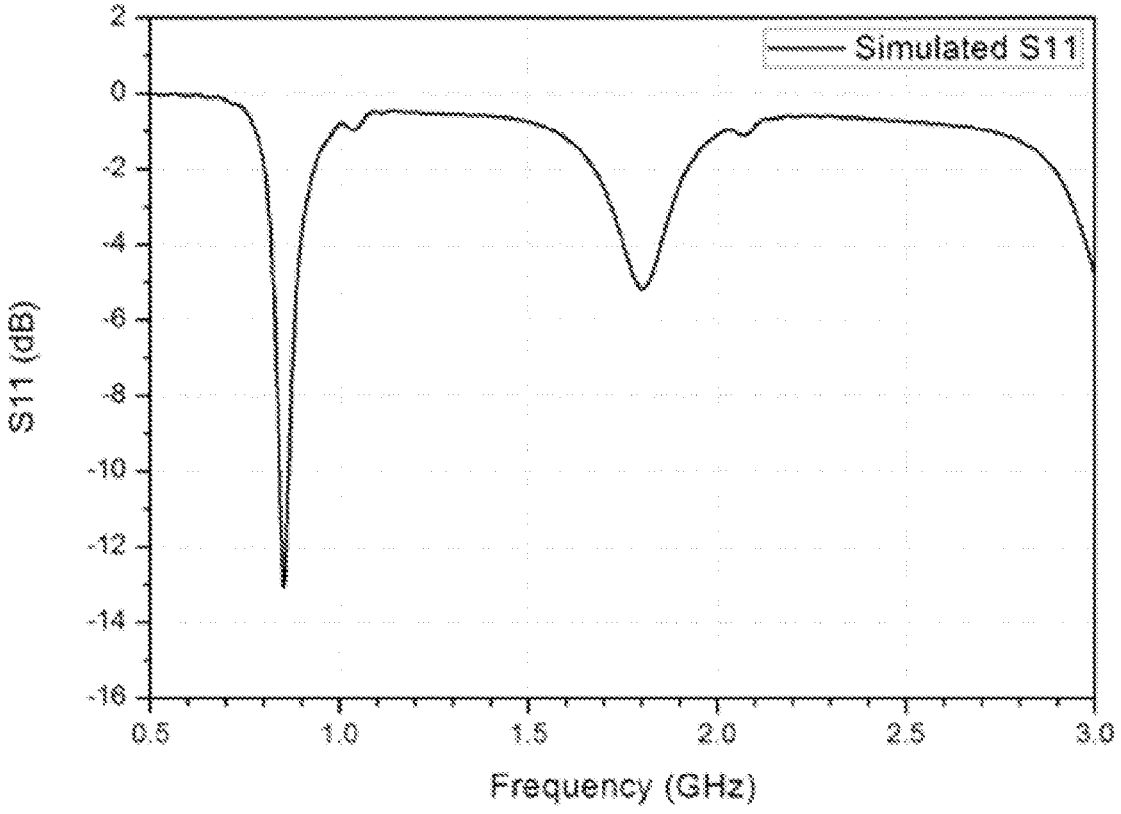
FIG. 34 is a graph showing measurement results of the reflection coefficient for the slot antenna of FIG. 33.

FIG. 33 is a view showing a slot antenna according to a fourteenth exemplary embodiment of the present invention. FIG. 34 is a graph showing measurement results of the reflection coefficient for the slot antenna of FIG. 33.

Referring to FIGS. 33 and 34, the slot antenna of this invention comprises a main slot 116 which is formed along the corner of a conductive housing 300 and the edges on either side of the corner and divided into two parts. Any one of the two parts divided from the main slot 116 is open. The feeding method used for the main slot 116 is the coupling feeding method of FIG. 7 or the direct feeding method. The inner core of the coaxial cable 200 is connected to the feeding PCB 202. The impedance matching circuit 204 (not shown) can be mounted on a feeding PCB 202 which is bonded to the conductive housing 300 at the feeding position 203.

Figure 35:
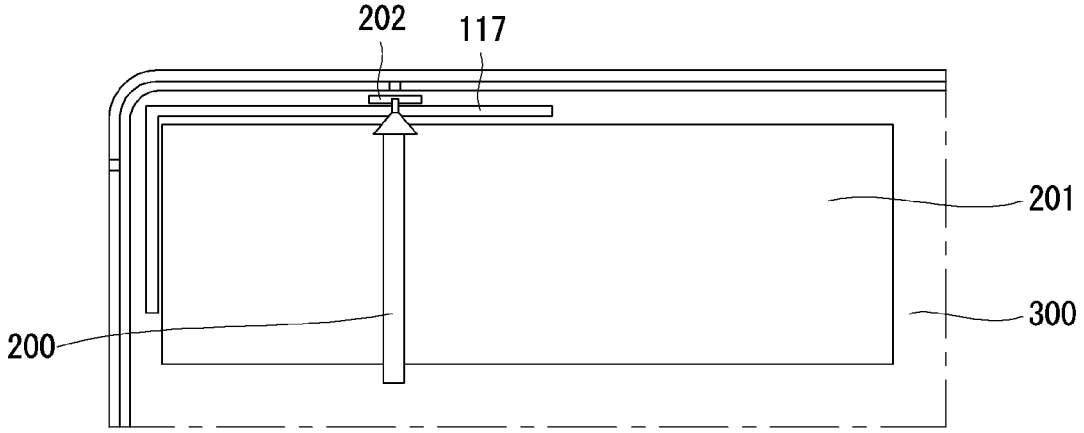
FIG. 35 is a view showing a slot antenna according to a fifteenth exemplary embodiment of the present invention.
Figure 36:
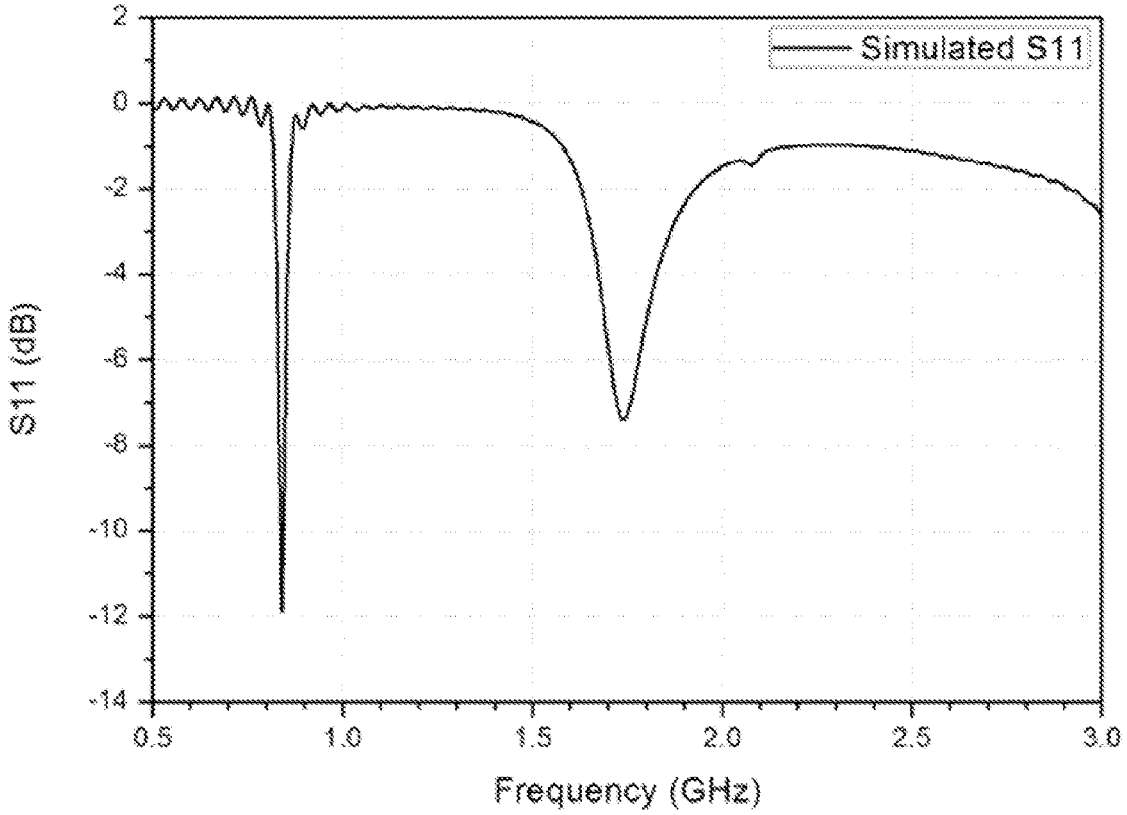
FIG. 36 is a graph showing measurement results of the reflection coefficient for the slot antenna of FIG. 35.

FIG. 35 is a view showing a slot antenna according to a fifteenth exemplary embodiment of the present invention. FIG. 36 is a graph showing measurement results of the reflection coefficient for the slot antenna of FIG. 35.

Referring to FIGS. 35 and 36, the slot antenna of this invention comprises a main slot 117 which is formed along the corner of a conductive housing 300 and the edges on either side of the corner and divided into two parts. Any one of the two parts divided from the main slot 117 is open and bent to wrap around two sides meeting at the corner of the conductive housing 300. The feeding method used for the main slot 117 is the coupling feeding method of FIG. 7 or the direct feeding method. The inner core of the coaxial cable 200 is connected to the feeding PCB 202. The impedance matching circuit 204 (not shown) can be mounted on a feeding PCB 202 which is bonded to the conductive housing 300 at the feeding position 203.

Figure 37:
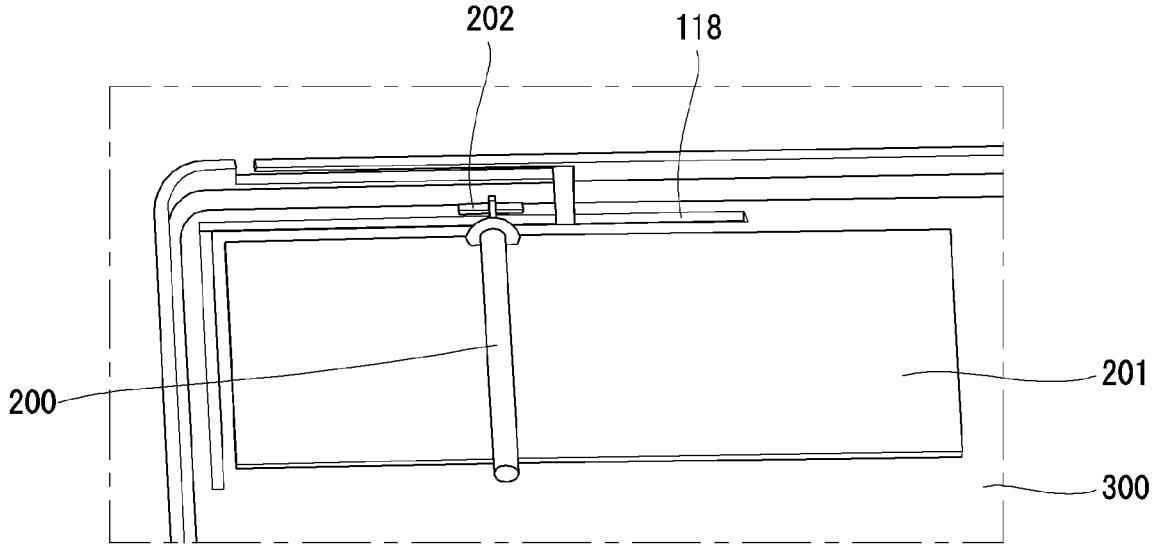
FIG. 37 is a view showing a slot antenna according to a sixteenth exemplary embodiment of the present invention.

FIG. 37 is a view showing a slot antenna according to a sixteenth exemplary embodiment of the present invention.

Figure 38:
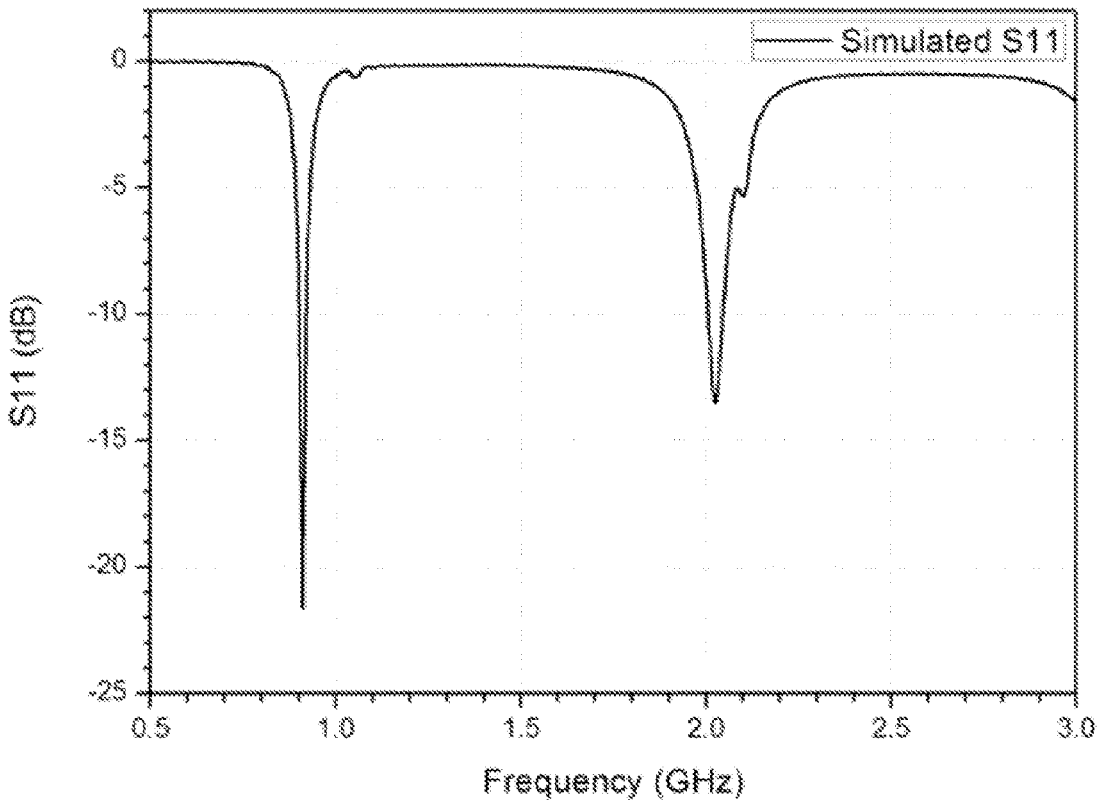
FIG. 38 is a graph showing measurement results of the reflection coefficient for the slot antenna of FIG. 37.

FIG. 38 is a graph showing measurement results of the reflection coefficient for the slot antenna of FIG. 37.

Referring to FIGS. 37 and 38, the slot antenna of this invention comprises a main slot 118 which is formed along the corner of a conductive housing 300 and the edges on either side of the corner and divided into two parts. Any one of the two parts divided from the main slot 118 is open and bent to wrap around one side of the conductive housing 300. The feeding method used for the main slot 118 is the coupling feeding method of FIG. 7 or the direct feeding method. The inner core of the coaxial cable 200 is connected to the feeding PCB 202. The impedance matching circuit 204 (not shown) can be mounted on a feeding PCB 202 which is bonded to the conductive housing 300 at the feeding position 203.

The slot antennas shown in FIGS. 31 through 38 have a dual slot structure in which the slot is divided into two parts. The dual slot structure has the advantage of being able to control the resonance frequencies of the lower and upper bands, individually, by adjusting the lengths of the divided parts of the slot. As can be seen from the measurement results of the test, an additional resonance occurs near 2 GHz. This resonance cannot be concluded as the primary resonance because the upper frequency band for the additional resonance occurring near 2 GHz can be controlled by adjusting the lengths of the slots divided from the main slot, independently from the resonance occurring in the lower band. On the contrary, the resonance occurring in the lower band also can be controlled, independently from the resonance occurring in the upper band. Meanwhile, the slot antennas shown in FIGS. 9 through 30 have a slot structure in which both ends are blocked, or a monopole slot structure in which one end is open. If the slot length for these slot antennas is adjusted to control the secondary resonance, the primary resonance frequency also changes, thus making it difficult to control the primary resonance frequency and the secondary resonance frequency, separately. In contrast, the upper and lower bands' frequencies for the slot antennas having the dual slot structure shown in FIGS. 31 through 38 can be separately controlled with ease by adjusting the lengths of the two divided parts. The main slot and parasitic slots of FIGS. 4*a* and 4*b* are an example of application of the dual slot structure. The number of parts into which the slots are divided is not limited to two. For example, at least one of the slots may be divided into two or more parts.

As discussed above, a slot antenna according to the present invention is formed directly near the corner or edge, which is far from a display panel, of a conductive housing incorporating the display panel, thereby making it easy for the information terminal apparatus to have a slim design, securing a sufficiently long bandwidth, and improving radiation efficiency.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A slot antenna, comprising:

a conductive housing including a bottom and sidewalls extending from the bottom;

a main slot disposed at a corner at which two sidewalls meet and including two or more slot segments that are interconnected, wherein a first segment of the main slot is formed on the bottom of the conductive housing and extends along the two sidewalls of the conductive housing meeting near the corner, and wherein a second segment of the main slot is formed on one of the two sidewalls and extends parallel to the first segment; and at least one parasitic slot located adjacent to the main slot and separated from the main slot.

2. The slot antenna of claim 1, wherein the first segment of the main slot is formed at a first edge at which the bottom meets a first sidewall of the two sidewalls and a second edge at which the bottom meets a second sidewall of the two sidewalls.

3. The slot antenna of claim 2, wherein an end of the second segment of the main slot extends to an end of the conductive housing and is open.

4. The slot antenna of claim 1, wherein an end of the parasitic slot extends to an end of the conductive housing and is open.

5. An information terminal apparatus, comprising:

a display panel;

a conductive housing including a bottom and sidewalls extending from the bottom configured to surround sides and a back of the display panel;

a main slot disposed at a corner at which two sidewalls meet and including two or more slot segments that are interconnected, wherein a first segment of the main slot is formed on the bottom of the conductive housing and extends along the two sidewalls of the conductive housing meeting near the corner, and wherein a second segment of the main slot is formed on one of the two sidewalls and extends parallel to the first segment; and at least one parasitic slot located adjacent to the main slot and separated from the main slot.

6. The information terminal apparatus of claim 5, wherein the main slot does not overlap the display panel with respect to a direction normal to the display panel.

7. The information terminal apparatus of claim 5, wherein the first segment of the main slot is formed at an edge at which the bottom meets a first sidewall of the two sidewalls and an edge at which the bottom meets a second sidewall of the two sidewalls.

8. The information terminal apparatus of claim 7, wherein an end of the second segment of the main slot extends to an end of the conductive housing and is open.

9. The information terminal apparatus of claim 5, wherein an end of the parasitic slot extends to an end of the conductive housing and is open.

10. The information terminal apparatus of claim 5, wherein the parasitic slot do not overlap the display panel with respect to a direction normal to the display panel.

* * * * *